US007769232B2

(12) United States Patent
Downs, III

(10) Patent No.: US 7,769,232 B2
(45) Date of Patent: Aug. 3, 2010

(54) UNIQUE SENSING SYSTEM AND METHOD FOR READING PLAYING CARDS

(75) Inventor: Justin G. Downs, III, Henderson, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 1227 days.

(21) Appl. No.: 11/152,475

(22) Filed: Jun. 13, 2005

(65) Prior Publication Data

US 2005/0242500 A1 Nov. 3, 2005

Related U.S. Application Data

(63) Continuation-in-part of application No. 10/915,914, filed on Aug. 10, 2004, now Pat. No. 7,264,241, which is a continuation-in-part of application No. 10/880,408, filed on Jun. 28, 2004, now abandoned, which is a continuation-in-part of application No. 10/622,321, filed on Jul. 17, 2003, now Pat. No. 7,029,009.

(51) Int. Cl.
*G06K 9/00* (2006.01)
*A63F 1/06* (2006.01)
*A63F 1/14* (2006.01)

(52) U.S. Cl. ..... 382/181; 382/100; 273/148 A; 273/149 R

(58) Field of Classification Search ..... 273/149 R, 273/292, 274, 149 P, 148 R, 309, 303; 463/11–42; 209/587, 547, 939; 382/100, 181
See application file for complete search history.

(56) References Cited

U.S. PATENT DOCUMENTS 3,222,071 A 12/1965 Lang (Continued)

FOREIGN PATENT DOCUMENTS

CA 2612138 12/2006

(Continued)

OTHER PUBLICATIONS

"Tracking the Tables", by Jack Bularsky, Casino Journal, May 2004, vol. 17, No. 5, pp. 44-47.

(Continued)

*Primary Examiner*—Sheela C Chawan
(74) *Attorney, Agent, or Firm*—Mark A. Litman & Associates, P.A.

(57) ABSTRACT

A sensing system for determining the rank and suit of playing cards is disclosed. The system includes a sensing module capable of reading a line of data from a printed image, a position sensor and a hardware component that combines the signals from the sensing module and position sensor, converts the signal to binary values and compares the converted signal to stored signals. The comparisons are correlated to identify card rank and Suit. The system can be used in a playing card delivery shoe used to control the game of baccarat. The shoe may be a customary dealing shoe equipped with a sensing module, or may be a mechanized shoe. The mechanized shoe may comprise a) an area for receiving a first set of playing cards useful in the play of the casino table card game of baccarat; b) first card mover that moves playing cards from the first set to a playing card staging area wherein at least one playing card is staged in an order by which playing cards are removed from the first set of and moved to the playing card staging area; c) second playing card mover that moves playing cards from the playing card staging area to a delivery area wherein playing cards removed from the staging area to the delivery shoe are moved in the same order by which playing cards were removed from the first set of playing cards and moved to the playing card staging area; and d) playing card reading sensors that read at least one playing card value of each playing card separately after each playing card has been removed from the area for receiving the first set of playing cards and before removal from the playing card delivery area One exemplary sensing system is a CIS line scanning system with an associated card position sensor and a FPGA hardware element.

24 Claims, 7 Drawing Sheets

U.S. PATENT DOCUMENTS 4,494,197 A 1/1985 Troy et al.
4,534,562 A 8/1985 Cuff et al.
4,667,959 A 5/1987 Pfeiffer et al.
4,750,743 A 6/1988 Nicoletti
4,926,327 A 5/1990 Sidley
4,995,615 A 2/1991 Cheng
5,179,517 A 1/1993 Sarbin et al.
5,209,476 A 5/1993 Eiba
5,224,712 A 7/1993 Laughlin et al.
5,257,179 A 10/1993 DeMar
5,276,312 A 1/1994 McCarthy
5,283,422 A 2/1994 Storch et al.
5,356,145 A 10/1994 Verschoor
5,362,053 A 11/1994 Miller
5,374,061 A 12/1994 Albrecht
5,470,079 A 11/1995 LeStrange et al.
5,586,766 A 12/1996 Forte et al.
5,586,936 A 12/1996 Bennett et al.
5,605,334 A 2/1997 McCrea, Jr.
5,613,912 A 3/1997 Slater
5,655,961 A 8/1997 Acres et al.
5,669,816 A 9/1997 Garczynski et al.
5,681,039 A 10/1997 Miller
5,722,893 A 3/1998 Hill et al.
5,735,525 A 4/1998 McCrea, Jr.
5,770,553 A 6/1998 Franchi
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,911,626 A 6/1999 McCrea, Jr.
5,919,090 A 7/1999 Mothwurf
5,941,769 A 8/1999 Order
5,989,122 A 11/1999 Roblejo
6,039,650 A 3/2000 Hill
6,071,190 A 6/2000 Weiss et al.
6,093,103 A 7/2000 McCrea, Jr.
6,117,012 A 9/2000 McCrea, Jr.
6,126,166 A 10/2000 Lorson et al.
6,165,069 A 12/2000 Sines et al.
6,217,447 B1 4/2001 Lofink et al.
6,250,632 B1 6/2001 Albrecht
6,267,248 B1 7/2001 Johnson et al.
6,267,671 B1 7/2001 Hogan
6,270,404 B2 8/2001 Sines et al.
6,293,864 B1 9/2001 Romero
6,299,536 B1 * 10/2001 Hill ..... 463/47
6,313,871 B1 11/2001 Schubert
6,346,044 B1 2/2002 McCrea, Jr.
6,361,044 B1 3/2002 Block et al.
6,403,908 B2 * 6/2002 Stardust et al. ..... 209/587
6,443,839 B2 9/2002 Stockdale et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,582,301 B2 6/2003 Hill
6,582,302 B2 6/2003 Romero
6,585,586 B1 7/2003 Romero ..... 463/12
6,585,856 B2 7/2003 Zwick et al.
6,595,857 B2 7/2003 Soltys et al.
6,616,535 B1 9/2003 Nishizaki et al.
6,622,185 B1 9/2003 Johnson et al.
6,629,889 B2 10/2003 Mothwurf
6,629,894 B1 10/2003 Purton
6,638,161 B2 10/2003 Soltys et al.
6,645,068 B1 11/2003 Petermeier et al.
6,645,077 B2 11/2003 Rowe
6,652,379 B2 11/2003 Soltys et al.
6,663,490 B2 12/2003 Soltys et al.
6,666,768 B1 12/2003 Akers
6,685,567 B2 2/2004 Cockerille et al.
6,685,568 B2 2/2004 Soltys et al.
6,688,979 B2 2/2004 Soltys et al.
6,712,696 B2 3/2004 Soltys et al.
6,719,634 B2 4/2004 Mishina et al.
6,746,333 B1 6/2004 Onda et al.
6,758,751 B2 7/2004 Soltys et al.
6,758,757 B2 7/2004 Luciano, Jr. et al.
6,804,763 B1 10/2004 Stockdale et al.
2001/0036231 A1 11/2001 Easwar et al.
2001/0036866 A1 11/2001 Stockdale et al.
2002/0107067 A1 8/2002 McGlone et al.
2002/0187821 A1 12/2002 Soltys et al.
2002/0187830 A1 12/2002 Soltys et al.
2005/0037843 A1 * 2/2005 Wells et al. ..... 463/30
2005/0137005 A1 * 6/2005 Soltys et al. ..... 463/13
2005/0242500 A1 11/2005 Downs, III
2006/0027970 A1 * 2/2006 Kyrychenko ..... 273/309
2006/0279040 A1 12/2006 Downs, III

FOREIGN PATENT DOCUMENTS

CN 101127131 2/2008
WO WO 9943404 9/1999
WO WO 00/51076 8/2000

OTHER PUBLICATIONS

"Error Backpropagation," http://willamette.edu~gorr/classes/cs449/backprop.html (4 pgs).
Genevieve Orr, CS-449: Neural NetworksWillamette University, http://www.willamette.edu/~gorr/classes/CS449/intro.html (4 pgs).
Christos Stergiou and Dimitrios Siganos, "Neural Networks," http://www.doc.ic.ac.uk/~nd/surprise_96/journal/vol4/cs11/report.html (13 pgs).
Related PCT International Search Report and Written Opinion—International Patent Application Serial No. PCT/US2006/22911, Dec. 28, 2006.
Related Malasian Patent Application Preliminary Examination, Search and Substantive Examination Reports—Malasian Patent Application Serial No. PI 20062710, Sep. 6, 2006.
Related Malasian Patent Application Substantive Examination Adverse Report—Malaysian Patent Application Serial No. PI 20062710, Sep. 6, 2006.
Related Philippines Patent Application Formality Examination Report—Philippines Patent Application Serial No. 1-2006-000302 Jun. 13, 2006.
Related Singapore Patent Application Examination Report—Singapore Patent Application Serial No. SE 2008 01914 A, Aug. 6, 2006.
Related European Patent Application Search Report—European Patent Application No. 06772987.1. Dec. 21, 2009.
Press Release for Alliance Gaming Corp., Jul. 26, 2004—Alliance Gaming Announces Contract With Galaxy Macau for New MindPlay Baccarat Table Technology, http://biz.yahoo.com/prnews.
"Tracking the Tables", by Jack Bularsky, Casino Journal, May 2004, vol. 17, No. 5, pp. 44-47.

* cited by examiner

Figure 7 Error Correction

UNIQUE SENSING SYSTEM AND METHOD FOR READING PLAYING CARDS

RELATED APPLICATION DATA

This application is a continuation-in-part of U.S. patent application Ser. No. 10/915,914, filed Aug. 10, 2004, now U.S. Pat. No. 7,264,241, which is a continuation-in-part application of both U.S. patent application Ser. No. 10/622,321, filed Jul. 17, 2003, now U.S. Pat. No. 7,029,009 and U.S. patent application Ser. No. 10/880,408, filed Jun. 28, 2004.

BACKGROUND OF THE INVENTION

1. Field of the Invention

The present invention relates to the field of gaming, the field of casino table card gaming, and devices and methods for measuring the rank and suit of cards used in the play of casino card games.

2. Background of the Art

Cards are ordinarily provided to players in casino table card games either directly from a deck held in the dealer's hands, as a group from a hand-forming and shuffling device or with cards removed by the dealer from a dealing shoe. The original dealing shoes were little more than trays that supported the deck(s) of cards in a tray and allowed the dealer to remove the front card (with its back facing the table to hide the rank of the card) and deliver it to a player. Over the years, both stylistic and functional changes have been made to dealing shoes, which have been used for blackjack, poker, baccarat and other casino table card games.

Numerous patents have been issued for inventive equipment and methods used to advance the art casino card game play. For example, U.S. Pat. Nos. 6,585,586; 6,582,302; and 6,293,864 (ROMERO) describe a gaming assembly to play a variation of the game baccarat, the gaming assembly including a computer processor assembly, a display assembly and at least one user actuatable selector assembly. The computer processor assembly is structured to generate a player's hand and a banker's hand in accordance with rules of baccarat, one of those hands being designated the user's hand. Further, the computer processor assembly is structured to determine a winning hand in accordance with the rules of baccarat, designating the user as a winner if the user's hand is also the winning hand. Additionally, the computer processor assembly is structured to monitor consecutive ones of the user's hands and to indicate a bonus payout to the user in the event that consecutive ones of the user's hands have a final number count equal to a natural nine.

Other patents relate to the structure and function of automatic card shufflers, U.S. Pat. No. 4,667,959 (PFEIFFER) describes a card handling apparatus including a card hopper adapted to hold from one to at least 104 cards, a card carousel having slots for holding cards, an injector for sequentially loading cards from the hopper into the carousel, output ports, ejectors for delivering cards from the carousel to any one of the output ports, and a control board and sensors, all housed in a housing. The apparatus is capable of communicating with selectors that are adjustable for making card selections. The injector has three rollers driven by a motor via a worm gear. A spring-loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus.

U.S. Pat. No. 5,989,122 (ROBLEJO) relates to an apparatus for randomizing and verifying sets of playing cards. Also, the invention relates to a process of providing such an apparatus; feeding to the apparatus one or more cards either after they have been played in a game or from an unrandomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus.

U.S. Pat. No. 6,267,648 (JOHNSON) describes a collation and/or sorting apparatus for groups of articles is exemplified by a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines according to a preprogrammed routine whether cards identified by sensor (15) are collated in the magazine (20) as an ordered deck of cards or a randomly ordered or "shuffled" deck. No specific reading mechanism is provided.

A number of patents relate to card dispensing shoes. U.S. Pat. No. 4,750,743 (NICOLETTI) describes the use of a mechanical card dispensing means to advance cards at least part way out of a dealing shoe. The described invention is for a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advances means contacting the trailing card and adapted to urge the stacked cards down the inclined floor; card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,779,546 (MEISSNER) describes a method and apparatus including an automated dealing shoe to enable a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe. This patent discloses the use of card readers for the play of Blackjack.

U.S. Pat. Nos. 5,605,334; 6,093,103 and 6,117,012 (McCREA) disclose apparatus for use in a security system for card games. A secure game table system is described for monitoring each hand in a progressive live card game, the progressive live card game having at least one deck, said at least one deck having a predetermined number of cards. The secure game table system comprises: a shoe for holding each card from said at least one deck before being dealt by said dealer in said hand, said shoe having a detector for reading at least the value and the suit of said each card. For the most part, unique codes are provided on the cards, although it may be inferred that cards can be read in some undefined, alternative manner.

U.S. Pats. No. 6,582,301; 6,299,536; 6,039,650; and 5,722,893 (HILL) describes a dealing shoe that has a card scanner which scans indicia on a playing card as the card moves along and out of a chute by manual direction by the dealer in the normal fashion. The scanner can be one of several different types of devices that will sense each card as it is moved downwardly and out of the shoe. A feed forward neural-network is trained, using error back-propagation to recognize all possible card suits and card values sensed by the scanner. Such a neural-network becomes a part of a scanning system which provides a proper reading of the cards to determine the progress of the play of the game including how the game might suffer if the game players are allowed to count cards using a card count system and perform other acts which would limit the profit margin of the casino. Scanned information is fed to a computer for extensive analysis. Apparently the entire marking image is read or a bar code is read.

U.S. Pat. No. 6,126,166 (LORSON) describes a system for monitoring play of a card game between a dealer and one or more players at a playing table, comprising: (a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem. The subsystem may be adapted to: receive the transition signals generated by the active card-recognition sensors; determine, in real time and based on the transition signals, playing-card values for the dispensed standard playing cards; and determine, in real time, a current table statistical advantage/disadvantage relative to the players for playing cards remaining in the card-dispensing shoe.

Patents in the art describe card sorting devices. U.S. Pat. No. 6,250,632 (ALBRECHT) describes an apparatus and method for sorting cards into a predetermined sequence. One embodiment provides a deck holding area in which cards are held for presenting a card to a reading head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read head, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values.

U.S. Pat. No. 6,403,908 (STARDUST) describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. No specific reading mechanism is provided. If a playing card has not been rejected based upon improper color of the back of the card, the embedded processor then determines the rank and suit (position) of the card in a properly sequenced deck of cards, using digital image processing to compare the digital images obtained from that specific playing card against the plurality of stored card images which comprise a complete 52-card deck. This step either comprises an application of pattern recognition technology or other image comparison technology.

WO 00/51076 and U.S. Pat. No. 6,629,894 (DOLPHIN ADVANCED TECHNOLOGIES PTY. LTD.) disclose a card inspection device that includes a first loading area adapted to receive one or more decks of playing cards. A drive roller is located adjacent the loading area and positioned to impinge on a card if a card were present in the loading area. The loading area has an exit through which cards are urged, one at a time, by a feed roller. A transport path extends from the loading area exit to a card accumulation area. The transport path is further defined by two pairs of transport rollers, one roller of each pair above the transport path and one roller of each pair below the transport path. A camera is located between the two pairs of transport rollers, and a processor governs the operation of a digital camera and the rollers. A printer produces a record of the device's operation based on an output of the processor, and a portion of the transport path is illuminated by one or more blue LED's.

A number of patents describe card reading devices on gaming tables. For example, U.S. Pat. No. 5,681,039 (MILLER) describes a "no peek" device for speeding the pace of a game of blackjack. The device is comprised of a housing having a top surface. A card reader for reading at least a portion of a playing card is located within the housing. An indicator cooperating with the card reader is provided to inform the dealer if his down card is of a desired value. There is also disclosed herein a method for increasing the speed of play in an organized game of blackjack. It indicates the presence of an ace or ten as the hole card in the dealers Blackjack hand.

U.S. Pat. No. 6,217,447 (LOFINK) describes a method and system for generating displays related to the play of Baccarat. Cards dealt to each of the Banker's and Player's hands are identified as by scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions. The cards are read between the shoe and the player positions, outside of the shoe.

U.S. Pat. Nos. 5,669,816 and 5,772,505 (GARCZYNSKI) describes a dual card scanning module announces when the symbols of a face-up standard playing card and a face-down standard playing card achieve a desired combination (a blackjack). The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the face-down standard playing card. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination.

Casinos wish to understand the play and wagering traits of their customers. Some casinos have employees visually observe customer's game play, manually tracking the gaming and wagering habits of the particular customers. The information allows the casinos to select the number of different games that the casino will provide and to adequately staff those games. The information also allows the casinos to select certain customers to receive complimentary benefits ("comps") and to determine the amount of comps a particular customer is to receive. The act of giving comps to a customer produces a large amount of goodwill with the customers, encouraging customer loyalty and further wagering. Some casinos have attempted to partially automate the tracking process, reading a customer "comp" card to identify the customer. The actual gaming and wagering patterns of the customers are visually observed by casino personnel and manually entered into a computer to create a digitized copy of the customer's gaming habits.

Similarly, casinos wish to track the efficiency of the casino and the casino's employees, as well as track betting and winning tendencies of individual players to avoid card counters or other play strategies that casinos consider to be undesirable. Such information allows the casino to make changes to identified situations and to increase the overall efficiency of the casino and of the employees, benefiting both the casino and customers. A typical method of tracking employee efficiency is to manually count the number of hands of blackjack dealt by a dealer over some time period. A change in an amount in a bank at the gaming table can also be manually determined and combined with the count of the number of hands to determine a won/loss percentage for the dealer. The casino can use the information to take appropriate action, such as rewarding an efficient dealer, or providing additional training to an inefficient dealer.

The fast pace and large sums of money make casinos regular targets for fraud, cheating and stealing. Casinos employ a variety of security measures to discourage cheating or stealing by both customers and employees. For example, surveillance cameras covering a gaming area or particular gaming table provide a live or taped video signal that security personnel can closely examine. Additionally, or alternatively, "pit managers" can visually monitor the live play of a game at the gaming table. The ability to track cards, track card play, track cards between a shuffling step (where the order of cards is identified by the shuffler through a reading function) and the dealing step (by reading cards in the dealing shoe) adds a further level of security to the casino and provides a clear basis of data for analysis by a central computer.

While some aspects of a casino's security system should be plainly visible as a deterrent, other aspects of the security should be unobtrusive to avoid detracting from the players' enjoyment of the game and to prevent cheaters and thieves from avoiding detection. The ability of a dealing shoe to accurately read cards outside the view of players is a benefit to the secure environment without increasing the negative effects of players repeatedly seeing security devices.

U.S. Pat. No. 5,941,769 (ORDER) describes a device for professional use in table games of chance with playing cards and gaming chips (jettons), in particular the game of "Black Jack." The apparatus includes a card shoe with an integrated device for recognition of the value of the drawn cards (3') (optical recognition device and mirroring into a CCD-image converter); photodiodes (52) arranged under the table cloth (51) in order to register separately the casino light passing through each area (53, 54) for placing the gaming chips (41) and areas (55, 56) for placing the playing cards (3) in dependence of the arrangement or movement of the jettons and playing cards on the mentioned areas; a device for automatic recognition of each bet (scanner to register the color of the jettons, or a RFID-system comprising a S/R station and jettons with integrated transponder); an EDP program created in accordance with the gaming rules to evaluate and store all data transmitted from the functional devices to the computer; and a monitor to display the run of the game and players' wins.

U.S. Pat. No. 6,460,848 (SOLTYS)—MindPlay LLC U.S. Patent describes another more comprehensive monitoring system that automatically monitors playing and wagering of a game, including the gaming habits of players and the performance of employees. A card deck reader automatically reads a symbol from each card in a deck of cards before a first one of the cards is removed. The symbol identifies a respective rank and suit of the card. A chip tray reader automatically images the contents of a chip tray, to periodically determine the number and value of chips in the chip tray, and to compare the change in contents of the chip tray to the outcome of game play for verifying that the proper amounts have been paid out and collected. A table monitor automatically images the activity occurring at a gaming table. Periodic comparison of the images identify wagering, as well as the appearance, removal and position of cards and other game objects on the gaming table. A drop box automatically verifies an amount and authenticity of a deposit and reconciles the deposit with a change in the contents of the chip tray. The drop box employs a variety of lighting and resolutions to image selected portions of the deposited item. The system detects prohibited playing and wagering patterns, and determines the win/loss percentage of the players and the dealer, as well as a number of other statistically relevant measures. The measurements provide automated security and real-time accounting. The measurements also provide a basis for automatically allocating complimentary player benefits. There are numerous other MindPlay LLC, including at this time U.S. Pat. Nos. 6,712,696; 6,688,979; 6,685,568; 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; and 6,517,435.

A number of techniques are known for processing data from an imager. Published U.S. Patent Application No. 20010036231 (Easkar) discloses an in-camera two-stage data compression process that reduces the latency between snapshots to a fraction of that otherwise required by other systems. Other known systems either process complete compression following each snapshot or incorporate heavy, bulky, and expensive RAM hardware capable of maintaining several raw luminosity records (unprocessed file containing a digital image). In the first stage compression, the raw luminosity record is quickly, yet partially, compressed to available RAM buffer space to allow a user to expeditiously capture a succeeding image. When the higher-priority processes, the user shooting pictures, and stage one compression subside, a second stage compression, which is slower but more effective, decompresses the earlier partially-compressed images, and re-compresses them for saving in flash memory until they are distributed to a remote platform to be finally converted to the JPEG2000 format.

In addition to the numerous advances in data acquisition and card handling for table games, there are a number of prior art patents that illustrate various methods of extracting gaming related data from images captured with a video camera. For example, Fishbine U.S. Pat. No. 5,781,647 describes a method of collecting images of a stack of chips on a gaming table, and Lindquist U.S. Pat. Nos. 5,781,647 and 6,532,297 describe techniques for extracting chip number and value information from video images of chip stacks. Similarly, there exists commercially available "machine vision" software that has been used in the past to extract data from digital image files. This technique is described for use in a card-reading device within a card shuffler, in commonly assigned co-pending application Ser. No. 10/954,029, filed Sep. 29, 2004 entitled Multiple Mode Card Shuffler and Card Reading Device (the content hereby incorporated by reference in its entirety) that can be purchased an adapted to extract rank and suit data from images of card faces captured with a video camera or other similar optical device capable of capturing two dimensional images.

Each of the references identified in the Background of the Art and the remainder of the specification, including the Related Application Data are incorporated herein by reference in their entirety as part of the enabling disclosure for such elements as apparatus, methods, hardware and software.

BRIEF DESCRIPTION OF THE INVENTION

Existing card recognition technology tends to be bulky, expensive, overindulgent in using computing resources and has also shown significant problems in card reading accuracy. The need for computing power in prior art systems has required that significant computing power needs to reside outside of the shoe or other card-reading device to actually provide rank and suit information (as opposed to mere signals provided by the sensors/readers/imagers in the shoe.

An improved system for obtaining information on the rank and suit of cards from standard symbols on playing cards focuses on using:

1) a simple imaging array or a small line sensor array to scan normal rank and suit information on the cards;
2) the transformation of the scanned information into binary information, because there is no need for more sophisticated shading, color or other optical density readings are obviated;
3) providing binary values from the gray scale information;
4) Simple template matching is used, to determine the identity of the image, rather than image abstraction.

One preferred construction embodying these objectives uses a contact image line sensing (CIS) array coupled to a position scanner as the image-reading element or sensor. A preferred CIS array is used to obtain information from multiple straight line scans positioned over the image being sensed. The CIS array provides an output represented as multiple acquired vectors, each vector represented by information from a line scan, forming a vector set, and hardware (such as ASIC or preferably an FPGA) is used to convert the vector sets into information signals representing rank and suit information. This is done by comparing the acquired vector sets (or a signals) with known (high quality) vector sets, and the known vector sets with the highest correlation to the acquired vector sets identifies suit and rank and the device can then initiate the sending of rank and suit information to a data storage medium or processor.

According to the invention, a vector is a mathematical construct having a magnitude and a direction. Preferred vectors according to the present invention are multi-dimensional.

The proposed device can be used as a stand-alone image reading device for playing cards or other objects bearing printed information and it can replace known camera/imaging/processor systems presently used in delivery shoes, discard racks, card verifying devices, deck and other card set verifying devices and shufflers with card reading capacity.

In other forms of the invention, the sensing system of the present invention can be used to sense three-dimensional objects such as stacks of chips located in a gaming table chip tray or chips inserted into a retaining device where images on the chips can be scanned at close proximity to the CIS sensing array. The device can also be adapted to read other printed materials such printed matter on driver's licenses, employee badges, player club cards and the like.

In one preferred form of the present invention, the scanning module includes a CIS sensor array, a card position sensor, a logic circuit and a hardware component used to obtain rank/suit information from the output of the hardware component. A preferred hardware component is a FPGA logic circuit.

Scanning modules of the present invention enable reading of different types and styles of card images without the need to realign or retrain the CIS array (by using column sums of selected indices of signals, and the known location of symbols (on the cards as they move over the CIS array)). Once the CIS array is trained to recognize locations, suit and rank, location information can be derived from acquired signals such that any brand of cards with rank and suit printings can easily be recognized by the device. Also card types that position the rank/suit information in a different area of the card are also recognized, as long as the new area is still within the boundaries of the CIS sensing array.

A position sensor is provided on the CIS module carrying the CIS array to perform two distinct functions: 1) to sense card movement and 2) to sense the presence of a card. The position sensor in one form of the invention is an optical sensor that continuously provides signals output to the FPGA regarding changes in the card's position. The optical sensor can be another CIS module, or can be one of a wide variety of other sensors capable of alerting the logic circuit that a card is present so that the CIS module can begin sensing, and to also alert the logic circuit to repeat the line scanning process once the card has been moved. For example, other position sensors can be ultrasonic sensor, capacitive sensor, inductive sensor, eddy current sensor and microwave sensor. Alternatively, the card present scanner can be used as a trigger to energize a card moving mechanism (if present) to move the card a specified distance or at a specified rate for a specified time so that the line scanning can be repeated on a different predetermined portion of the image. Communication with a hardware device such as a FPGA is typically through a digital I/O port, but can be via hard wire, a wireless connection a network connection or other known means of communication.

The CIS sensor array in a preferred embodiment performs the function of line scanning and can be triggered to read an additional line when the card moves at least a predetermined distance, a predetermined rate during a time interval or after a specified time interval. The read line information can be provided as a voltage signal vs. distance or time or can alternately be provided as a series of content gray scale values for the line, vs. time or distance, as opposed to providing detailed two-dimensional image data. In the case of a scanner that outputs gray scale values, those values are then converted in a separate step into binary values, either by using a separate device such as an analog to digital converter or in the FPGA.

In one embodiment of the invention using a CIS sensor as a position sensor, the position sensor output is a series of voltages vs. time (or distance along the line) and this output is converted in a logic board into binary values. In another embodiment, the sensor itself outputs digital gray scale values and the conversion into binary values vs. time (or distance along the line) is made by a hardware circuit.

If the sensor output is gray scale values, the gray scale value vectors and the location vectors may be inputted into the FPGA circuit where the vectors are combined to arrive at gray scale vs. card location information. This information is converted into binary information, and the binary value vectors are compared to known binary value vectors to determine rank and suit. In another form of the invention, the binary values vs. time (or position) from both the line scanner and position sensor are inputted into the FPGA where an acquired vector set corresponding to the scanned card is constructed. It is to be understood that the data processing performed by the FPGA creates the acquired vector set from inputs, and then compares the acquired vector set to known vector sets to separately determine rank and suit. Separate vector sets corresponding to read rank and read suit are compared to stored vector sets of known rank and suits.

For example, a single scanned line can produce an output of a plurality of gray scale values between 0 (white) and 255 (black) or any other linear or exponential scale, vs. time or distance along the line. Each line is represented by a vector, each vector including multiple values between 0 and 255, for example. The gray scale values are converted to binary (or black and white) values (black being 0 and white being 1, for example). The converted vectors (scan line values) are combined with other vectors from one or more additional line scans taken of the same image at a different location and these vectors are combined to form an acquired vector set. These vector sets are compared with known vector sets through the hardware (e.g., ASIC or FPGA) and the closest correlation results in an identification of the suit and rank of the card.

According to one aspect of the invention, the number of vectors needed to accurately identify the image must be determined in advance and appropriate vector sets stored in the FPGA (or in associated memory) in order to "train" the sensing system to recognize a particular set of images. It has been found that multiple line scans are needed to accurately identify a card rank and suit.

DETAILED DESCRIPTION OF THE INVENTION

The present invention is a scanning system suitable for determining the rank and suit of cards being scanned. The present system can also be used to read printed or embedded information on other stationary objects positioned in close proximity to the scanning device. A preferred scanning system employs a unique CIS sensing array (Contact Image Sensor) line scanning device that includes a plurality of individual of scanning sensors arranged into a one-dimensional array and generates an output signal represented as voltage vs. time (or position). The line scanner is coupled to a position sensor and the outputs are used to construct a mathematical vector set that represents the rank or suit of a card. A unique feature of the present invention is that the output from the line scanner and position sensor are signals that cannot be used to reconstruct a digital image of rank and suit. Rather, the signals are more akin to creating a simplified, short hand version of the image, and require much less memory and computing capacity to analyze, as compared to extracting data from a two-dimensional digital image.

Figure 4:
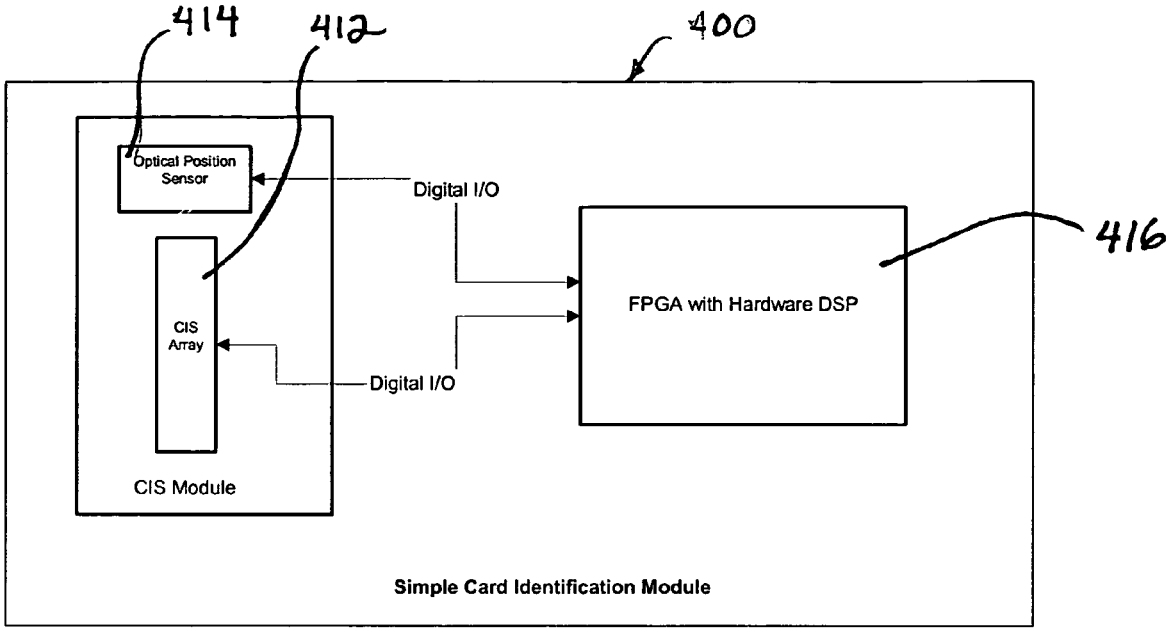
FIG. 4 is a diagram of a scanning system of the present invention adapted to read card rank and suit.

According to one form of the invention, as shown in FIG. 4, the sensing system 400 of the present invention includes a CIS sensing line scanner 412 that is used to scan a straight line extending across one or more specified areas of a printed image.

The CIS line scanner 412 may be any linear image capture system that can provide data representing a scanned line, preferably continuous line data, and provide those line data or images on demand. A preferred system is a contact image sensor or contact image sensor line scanner (CIS) 412 that is a type of optical flatbed scanner that collects light reflected off of an object. One such suitable array can be purchased by ordering model M106-A8 from CMOS Sensor Inc, 20045 Stevens Creek Blvd., Suite 1A, Cupertino, Calif. 95014.

CIS sensing does not use the traditional CCD arrays that rely on a system of mirrors and lenses to project the scanned image onto the arrays. Preferred CIS scanners gather light of a single wavelength, however color versions are also available. The gathered light is directed at the original document being scanned. A color sensitive CIS is not required, as black-and-white images of the line scans are sufficient to identify card suit and rank. The light that is reflected from the original is gathered by a lens and directed at an image sensor array that rests just under the document being scanned. The sensor then records the line scan according to the intensity of light that hits the sensor. A CIS scanner is more compact than a CCD imaging device (a CCD scanner requires a focal distance between the camera and the object being imaged) and can be used in smaller products than CCD imaging technologies. CIS scanners also require less power than CCD imagers and often can run off battery power or the power from a USB port. CCD imagers, however, provide higher-resolution signals. It was initially assumed that such high-resolution scanning is unnecessary to identify the rank and suit of playing cards with sufficient accuracy for the purpose of reading cards being dealt into a casino type card game.

As shown in FIG. 4, the CIS line scanner 412 resides on a CIS module 400. The module 400 can be used as a stand-alone unit on a card table surface, for example, or can be incorporated into a card handling device such as a card shoe, a card shuffler, a card sorting or a card/deck/multiple deck verification device.

The sensor line scanner 412 performs the function of line sensing (that is, it senses optical density along one line at a time), and is able to be re-triggered to read a new line every time the card moves certain distances or certain periods of time during movement, or at any other basis of providing intervals (spaced line scans) along the card symbol. Typically, the spacing between scans is fixed at a certain distance for all scanning within a group, such as when scanning for card suit or card rank. Typically, multiple line scans, for example between five and forty line scans are needed to accurately identify a suit symbol or a rank symbol. However, the number of scans needed to accurately identify the particular symbol being scanned must be determined during the training process, which is described in more detail below.

The output voltage of the CIS line scan is a voltage vs. time (which can be correlated to distance along the line being scanned) and is converted externally to a string of binary values. It is possible to binary values rather than color values because for identification purposes, there is little difference between the black and red colors of typical playing cards. Because the sensing system is relying on shape only, the two colors can be converted to binary values representing 0 for black, and 1 for white. If the output from the line scanner is a gray scale value, the conversion from gray scale values to binary values can take place in the sensor logic board, in an analog to digital converter, on a separate logic board or within the FPGA hardware component.

Each gray scale value is an indication of the total optical density content vs. position on the scanned line. It was discovered that a simple black and white imaging system (represented by binary values) provided sufficient resolution to accurately distinguish between the rank and suit of each card in the deck, since it is only necessary for the system to detect shapes.

As an alternative, a color scanning system may be used, but it is essentially redundant or superfluous with respect to the needed image content for determining suit and rank. Plus, the signals being generated by such a scanning system would necessarily be more complex and would require more memory and computing resources to interpret the signals. In the preferred black and white system, the output of the CIS array would be converted into a series of numerical values between 0, meaning black, to 255 meaning white. This conversion can take place in the hardware component, or in a separate logic circuit (not shown). Any scanned shade of gray can be represented by a number between 0 and 255.

Referring back to FIG. 4, a card position sensor 414 is provided to advise the system of the location of the card relative to the CIS line scanner. The CIS line scanner 412 is activated when the image to be sensed is positioned proximate the CIS line scanner. After scanning, the card is then repositioned so that the CIS array can read another line of the image. In a preferred form of the invention, the CIS sensing array 412 performs a minimum of two line scans, and more typically thirty-five scans across specified locations of an area of the card representing rank and another area representing suit.

The output from the CIS array 412 and the output from the position sensor 414 are inputted into a logic circuit 416 such as a FPGA or other hardware device. The CIS signals, before input or after input into the FPGA (depending on the type of position sensor used) are either converted into a series of binary values or are converted into a series of vectors representing gray scale values and the gray scale values are then converted into binary values (vs. position) in the FPGA, or before the signals reach the FPGA. If the position sensor 414 and/or the CIS line scanner lacks the functionality of converting the output voltages from the sensors into gray scale information, an additional logic circuit (not shown) may be provided to perform this function. Alternatively, this conversion is completed in the FPGA hardware.

The output signals from both the position sensor 414 and the CIS line scanner 412 each define a vector set. A vector set represents a stream of data from multiple line scans. If only one line scan is sufficient to distinguish between the various suits, then the vector set is data from one line scan. If multiple line scans are needed, then the vector set is the data from multiple scans. These vector sets are combined in the FPGA and converted into a single vector set (of binary values vs. position) and are compared to stored vector sets representing known rank and suit values. The inputted vector sets are combined and then correlated statistically in the FPGA circuit to determine a rank and suit of each card. Communication between the various components of the scanning system in one form of the invention is by means of I/O interface. However, other forms of communication such as hardwire, wireless or network communication methods, among other known methods are contemplated. If the output from the position sensor and the line scanner is a series of voltages vs. position, a simple comparator circuit can be used to convert the voltages into binary values prior to input into the FPGA.

Figure 5:
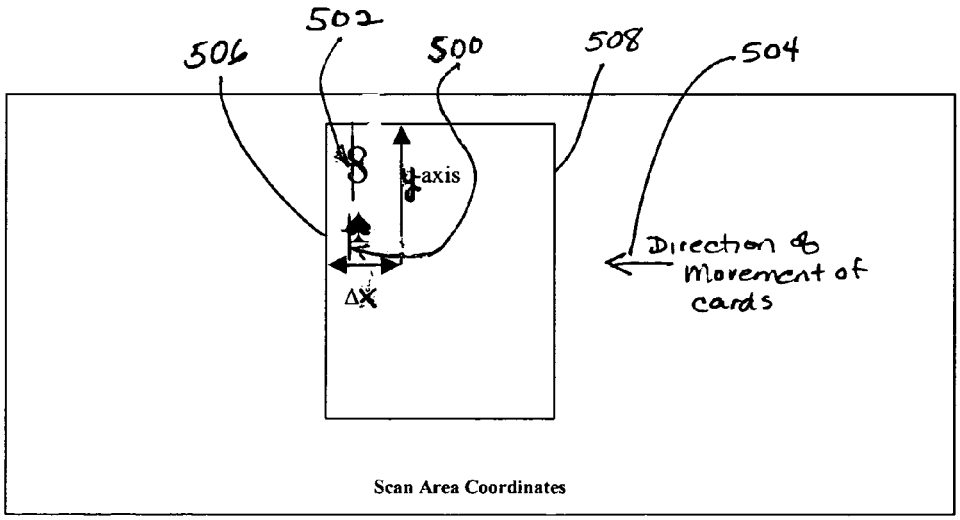
FIG. 5 is a diagram that illustrates an area of a card to be scanned and the coordinates used to generate the scan.

The proposed system scans lines within a designated area of the card face containing the symbols. As shown in FIG. 5, an area bounded by the coordinate lines X and Y is an example of an area of the card to be scanned.

According to the invention, a card position sensor 414 is provided to provide an output corresponding to the card position. The type of signal outputted depends upon the selection of the position sensor. In one example, another CIS sensor is provided to detect card position, and the output of this sensor is also a voltage vs. time (or position along the scanned line). This output signal is also a vector set.

The CIS line sensor 412 and the position sensor 414 may output two vector signals to a hardware component, which in one form of the invention is a field programmable gated array or FPGA. The image data (line scan) that is captured by the CIS, and 2) a position vector captured by the optical position sensor are inputted into the hardware component. In the FPGA, the two vectors (position and line scan data) are combined to form a vector set representative of card rank, and another two vector sets are combined to form a vector set representative of card suit. The voltage component of each combined signal is converted in into binary code. (i.e. a value of 1 or 0) either inside or outside the FPGA. If the binary conversion takes place outside of the FPGA, a device such as a comparator circuit can make the conversion. The resulting sensed, combined vector sets are compared with stored vector sets (representing known rank and suit) and the values are correlated to identify the rank and suit of the card.

A more direct type of signal processing is using a line sensor and position sensor that produces voltage vs. time output. But with other types of sensors, the outputs are gray scale values that must in turn be converted to binary values. The binary conversion from gray scale utilizes a threshold value so components of gray scale signal are converted to a 1 or a 0. Typically that threshold value is midrange value of the signal or 128. For instance, a number 10 is easily considered black, while a number of 220 are easily interpreted as white. The black values are reassigned a value of 0, and the white values are reassigned a value of 1.

In order to recognize each scanned rank and suit values, the system must first be trained or hardwired to recognize standard card rank and suit symbols. To accomplish this, a single vector set for each rank (A, K, Q, J, 10, 9, 8, 7, 6, 5, 4, 3, 2) and a vector set for each suit (Hearts, Clubs, Diamonds and Spades) is generated and saved (e.g., a known vector set is saved for each symbol) by acquiring a set of signals during a training phase, or by hardwiring the system based upon a known set of card symbols or using a large tolerance hardwiring for a range of symbols. The signals acquired during training undergo the same binary conversion and are stored. During the training phase, the determination of the number of scans necessary to accurately identify the shape must be made. This step is largely determined by the size and shape of the object being scanned. It was determined that for rank and suit values of a size typical of playing cards, a minimum of five scans, and a maximum of forty scans, and typically approximately thirty-five line scans per character produced the most reliable rank and suit reference vector sets. However, the number of scans is a function of the size, shape and color variation (if any) that is being scanned.

During the identification process, the assembly of a sensed vector set begins when a triggering signal is received from the position sensor 414. This unknown vector set, as indicated above, may be comprised of a single set of values (binary or gray scale) or a group of sets of values from multiple spaced scan lines. The triggering signal can take on many forms. The triggering mechanism can be an object position sensor 808, an edge sensor (indicating that a first leading edge of a playing card has passed over an optical or motion sensor), a motion sensor indicating movement of a playing card, a distance sensor, a speed sensor, an acceleration sensor, a CIS sensor indicating the presence of optical density other than white (e.g., a card sensor), a mechanical encoded wheel, mirror and laser arrangements, and the like.

Upon initial triggering of the spaced scan line sensor, the scanning may continue on a timed, measured distance or sensed distance (e.g., distance or speed of movement of the card, degree of variation in the signal from the line sensor, etc.) basis. To compensate for any motion of the card taking place during a scan, a fast scan time is used such as 1/1000 of a second or less. In the preferred and most simplified system, the card scanning system is incorporated into a card reading shoe, and all cards are drawn by dealer manually, so the speed of each drawn card varies with every scan, and the cards are being scanned while they are being withdrawn from the shoe. A position sensing device would therefore be more appropriate, rather than a timed sensor.

If automated card movement is provided, as by feeding individual cards past the sensor at a specified rate prior to manual removal, timed triggering, angular motion sensing, motion sensors or multiple position sensors may be more appropriate.

According to an aspect of the invention, a comparison of scanned vector sets with known vector sets is accomplished by means of performing a statistical correlation function. The purpose of the correlation is to compare each unknown vector set with each known vector set to determine which data sets are most highly correlated. The sets with the highest correlation values are considered matches.

The following equation is used to correlate an unknown vector set or signal A with known vector set B:

$$\frac{\sum\sum A*B}{\sqrt{\sum\sum A*A*\sum\sum B*B}} \tag{1}$$

Obviously this is a complex operation requiring significant computational power. However, when the vector sets are reduced to binary signals as constrained as described, the correlation reduces to a simple binary operation AND summation of the result over the entire vector. It can be shown mathematically that for the 2D case of shifting the template (i.e. vector set) over a 2D matrix containing an image of the image to be identified, this concept can be transferred to a 1D vector by shifting the order of the vector. If the vector set is a number of binary values, the denominator of this equation is equal to one, and the numerator is simply a binary operation and summation of the results.

An important aspect of the invention is in the accurate matching of unknown vector sets with known reference vector sets, even when there is variation in the positioning of the cards during a scan. One card may be in the correct position during a scan, but the next card might be positioned at an angle with respect to the line scanner. A correlation method was developed that addresses this problem. According to the method, a series of 'correlators' is generated in the FPGA that correlates each suit with the unknown vector either sequentially, or preferably concurrently. The FPGA performs the same function separately with vectors representing rank. After the correlation computation has been completed, the unknown vector is then shifted and a new series of correlation computations are performed. (The term "shifted" means that the top number pair of the series of values that constitutes the entire vector (each being a zero or a 1) is removed from the top of the vector and placed at the bottom of the vector, changing the order of the number pairs in the vector.) For example, a simple vector might be the following order pairs:

0,0
0,1
1,1
1,1
1,0
1,0
0,0
0,1

By shifting the top pair to the bottom, the vector becomes:

0,1
1,1
1,1
1,0
1,0
0,0
0,1
0,0

This process is continued over a wide range of shifts, preferably a number corresponding to the total number of number pairs in the signal. The results of the correlations are saved, and are compared with known values. The maximum correlation value (with respect to the known vectors) is then used to identify rank and suit. This process allows the intelligence to recognize images that are not in the expected location. This process improves the accuracy of the card identification process and adequately compensates for slight differences in the positions of the cards being read.

According to another aspect of the invention, additional error corrections have been incorporated into a preferred scanning system. As shown in FIG. 6C, it can be seen that a diamond shape can be fitted into the heart shape, when the suit symbols are approximately the same size. As a result, the diamond shape could possibly have been reported as both heart and diamond by the Card Identification Module. To avoid this type of misread, the inventor developed an error correction function to compare the "un-matched" area of the shapes. The error correction function is defined by the following equation:

$$\Sigma\Sigma A^{*}B-\Sigma\Sigma A'^{*}B \quad (2)$$

Where A is the unknown binary vector set and B is the known binary vector set. By using the technique, the device is able to detect the unmatched area shown in cross-hatching 702 in FIG. 7, and therefore identifies the correct shape. The term A' is simply the negative inverse of A. In FIG. 6C, a first vector set is formed for the area bounded by the diamond shape, and a second vector set is formed for the area representing the heart, less the diamond shape. This error detection method distinguishes completely between ranks, and the degree of error is much lower than when reading the entire area bounded by the heart shape and comparing that area to the area bounded by the diamond shape.

The proposed device is preferably implemented using FPGA technology (rather than using a microprocessor and memory) to improve the speed of identifying cards. Using a line scanner, a position scanner and a FPGA rather than a 2D imager and associated processor and memory dramatically reduces the cost of devices that identify the rank and suit of cards. Speed is improved because operations are performed in real time with hardware logic circuits instead of software running on a processor and being managed by an event cue. Costs are reduced because there is no longer any need for complex computational capability. Following a card identification cycle, the card ID data can be stored locally in memory associated with the FPGA, may be transmitted to a local database, or may be sent via a network connection to network memory.

One inventive aspect of the present technology is the use of a series of spaced line scans for reading cards. Previous systems that read conventional playing cards without special markings or machine readable codes thereon have basically taken two-dimensional full images of the rank and suit indicia (e.g., 2, 3, 4, 5, 6, 7, 8, 9, 10, J, Q, K or A and ♠ ♥ ♦or ♣, respectively), and the entire image was converted into a digital signal and compared to prerecorded or stored digital signals to determine the rank and suit. This required significant data collection and handling and more computing power than should have been needed, and also could allow for little tolerance in the comparison of images. It is described herein that only spaced line scans need be used in detecting suit and rank from scanning of the normal suit and rank indicators on playing cards. As little as two well positioned line scans on the suit symbols can theoretically distinguish among the four suits, and symbols, however a greater number of scans, such as 36 for example can also distinguish among rank and suit with a high degree of accuracy. Smaller numbers of scans could be used with card delivery devices that place cards proximate the line scanner with greater accuracy.

As shown in FIG. 5, the CIS line scanner 512 is measuring a light reflection density along a horizontally displaced scan line 500 (perpendicular to the direction of travel 504 of the card) as the identified lines 500 and 502 pass over a stationary sensor (the card is read face-down). Certain attributes can be produced only by individual symbols:

♠ ♥ ♦Z,2

Typically, cards are scanned from left to right, with the rank (top) and suit (below rank) being scanned simultaneously. For example, the following observations can be made from multiple line scans of the suits identified above. Only the spade and club can provide attributes of an extended base. Only the heart and diamond has a bottom point. Only the club and diamond has a point at the top of the image. Only the diamond has vertical symmetry. All four suits have symmetry along the horizontal X axis. Only the club has a wide base, and a width that steadily decreases, concluding at a point at the top of the image. These attributes and others may be defined by specific combinations of line scans. According to a preferred method, the scans are taken perpendicular to an axis of travel 504 of the card as the card is being scanned. Similarly, the images could alternately be scanned on an axis parallel to the axis of card movement 504 by reorienting the CIS scanner and other attributes used to determine suit and or rank. For identifying more complex images, it may be desirable to line scan in two directions, such as along an X and Y axis.

By determining the attributes of the line scans in the sequence in which they are taken from the playing cards, the suit and rank can be readily determined with less computing power or without any traditional computing power (including for example the use of a processor and associated memory). The additional scanner might be needed to distinguish suits on special cards, for example.

Figure 6:
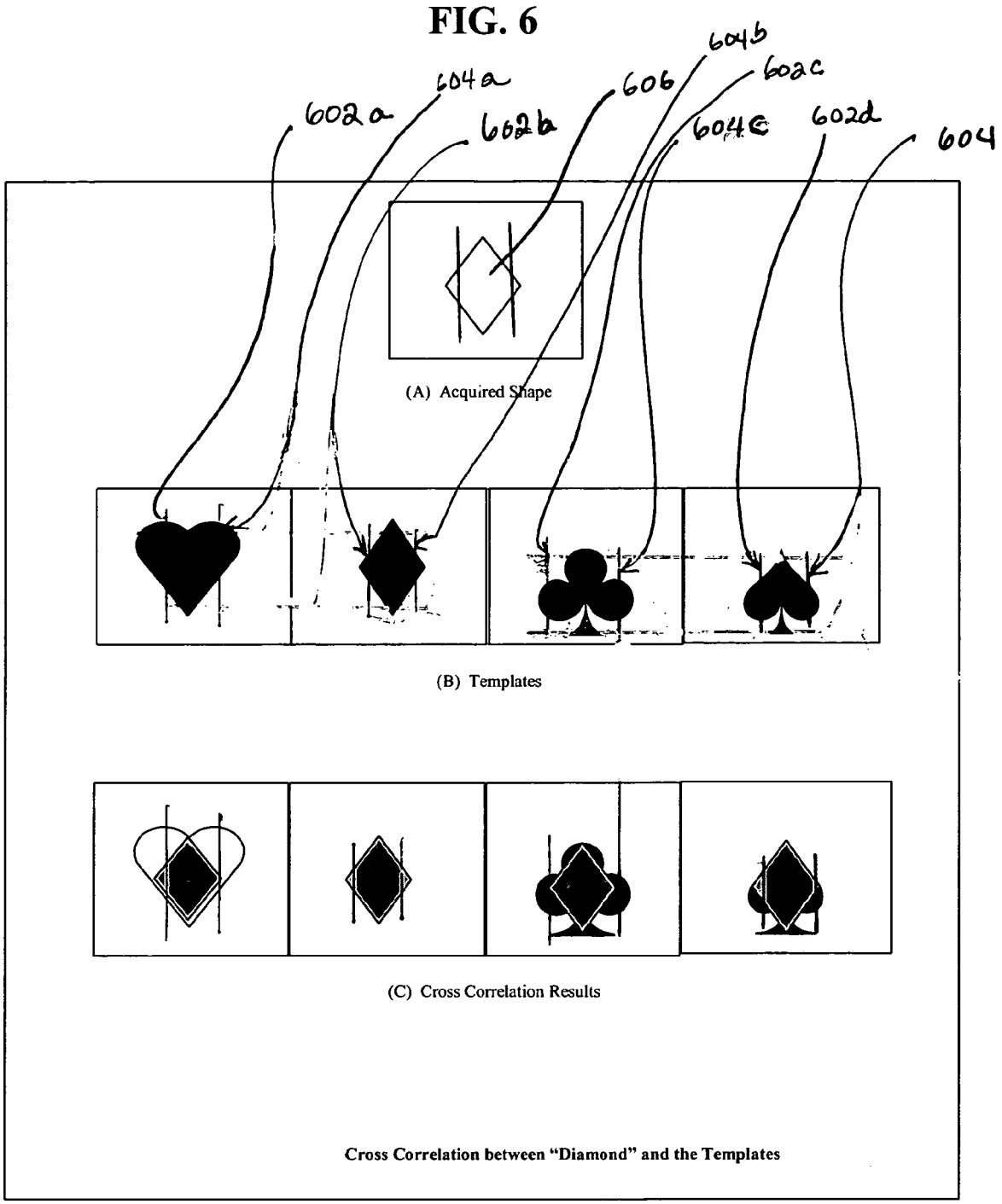
FIG. 6 is a diagram showing a scanned shape, a number of template shapes with stored vector set representations, and cross-correlation results.
Figure 7:
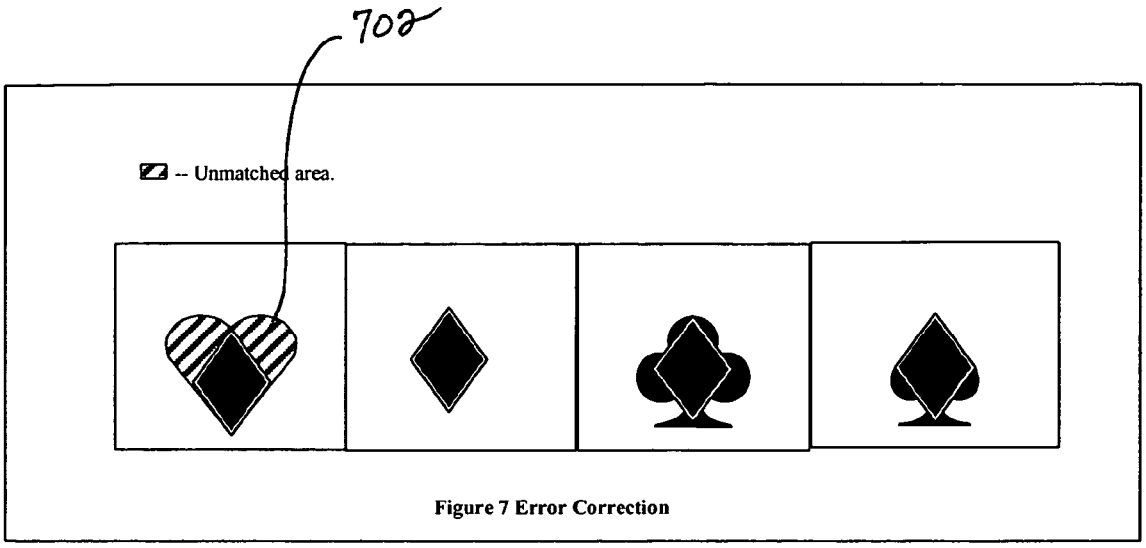
FIG. 7 is a diagram showing error correction.

Although it is desirable to perform multiple line scans in order to compile an acquired vector set for a particular scanned shape, the following illustrates such a construction with only two line scans. As shown in FIG. 6, in order to distinguish an acquired shape A between the four suits, scans are taken of known cards, first along position 602*a, b, c* and *d* and then along position 604*a, b, c* and *d*. The first scan 602 is taken as the leading edge of the card passes over the scanner. The first scan potentially distinguishes all of the suits from each other. The second scan may be necessary to distinguish the suits. These reference scans are combined to form a reference vector set, are stored in the FPGA and are used as a basis of comparison to a scanned image 606.

The number of line scans needed to accurately distinguish between images depends upon the nature of the graphics or images being scanned. It is therefore feasible in one example of the invention to provide an accurate reading of suit and rank symbols with as few as two well-positioned horizontal line scans per image, (two for rank and two for suit) as compared to having to scan the entire two-dimensional suit symbol and the entire two-dimensional rank symbol and compare these large image files with stored image files. Although a series of spaced line scans may be compared with a series of stored spaced line scan data sets corresponding to each distinct suit or rank symbol, the spaced line scans may alternatively be used for other purposes, such as to provide signals indicative of the properties or attributes of the individual line scans, and those properties or attributes may in turn be used by a number of different processing devices, including a hardware-based data transformer (e.g., ASIC or FPGA) to transform the signal to data without using a conventional processor.

Although the use of a FPGA is one preferred form of hardware 416 (shown in FIG. 4) that can be used to determine rank and suit, an ASIC can also be used. An ASIC is Application-Specific Integrated Circuit, a chip designed for a particular application. ASIC's are built by connecting existing circuit building blocks in new ways. Since the building blocks already exist in a library, it is much easier to produce a new ASIC than to design a new chip. However, the quantities needed to justify a manufacturing run of ASIC chips are large so the use of FPGA's is more desirable. In addition, FPGA's can be updated in the field, whereas ASIC chips must be replaced.

FPGA's are more preferred if the quantities needed for production are insufficient to instead use an ASIC. FPGA's, or field programmable gated arrays, are a type of logic chip that can be configured. The configuration is completed before the device is installed. An FPGA is similar to a programmable logic device (PLD), but whereas PLD's are generally limited to hundreds of gates, FPGA's support thousands of gates. They are especially popular for prototyping integrated circuit designs. Once the design is set, hardwired ASIC chips may be used as an alternative to FPGA's in order to obtain similar performance at a lower cost. However, ASIC chip design and manufacturing costs are high and are only justified when the volume of units needed is high, for example 250,000 units or more.

In a preferred form of the invention, only a portion of an area of the card face is scanned. As shown in FIG. 5, in conventional playing cards, the rank symbols (2, 3, 4, 5, 6, 7, 8, 9, 10, J, Q and K) are always nearest the top (long) edge 506 of the playing card. Thus, the line scan 502 taken by the scanner starting at the top will always read at least one line of rank and/or suit.

In a preferred embodiment, the CIS imager is of a sufficient size to scan an area slightly larger than the area bearing the rank and suit markings. In FIG. 5, a typical area to be scanned is bounded by the marked axes X and Y.

Within the CIS imager, only a portion of the imaging capacity of the sensing array is needed to collect sufficient data representing a line scan. For example, a small segment of the total length of the scanner is all that is needed to perform a line scan, when a much larger line sensing array is available in the CIS sensing chip. Using only a portion of the line scanner needed to read rank and suit reduces the amount of data being collected and processed.

In an alternate embodiment, the complexity of the graphics might require that a second sensing device be provided to line scan the rank and suit information printed near the trailing edge 508 of the same card. This redundancy might be desirable if a single scanned area does not prove to be sufficiently reliable to identify the image being scanned.

In one preferred form of the invention, the position scanner 414 measures the presence of the cards, as well as the position of the card. Because spaced line scans are used (a spaced line scan is defined as a set of at least two line scans made upon a single image wherein there is at least a space between lines scanned that is at least as wide as the scan width of the line itself, and thus less than 50% of the symbol area may actually be scanned), the speed of the card moving across the imaging area may vary significantly, without having any detrimental effect on the certainty of the suit and rank identification. Because attributes or combinations of line qualities in sequence may be used to determine the suit and rank, the precision of the image position relative to the scanner is not essential, as when a card may get slightly skewed by hand movement of the card, different speed, and rotational action on the cards by a dealer's hand. Variations in motion, speed and skew of the cards are preferably accounted for in the FPGA.

The scanning system of the present invention is compact and does not require external computing power to ascertain rank and suit. Because the system is simple, requires little physical space and a minimal amount of processing capability, the device can be incorporated into a number of card handling devices, such as a card shoe with no moving parts, a mechanized card shoe, a card shuffler, a card sorting and/or ordering device or a scanner built directly into the playing surface of a casino card table. Wherever a card can be put into close proximity to the CIS sensing array, the sensing device of the present invention is useful. A number of examples of application of the sensing system of the present invention are presented below.

Mechanized Dealing Shoe with CIS Scanning System

Figure 1:
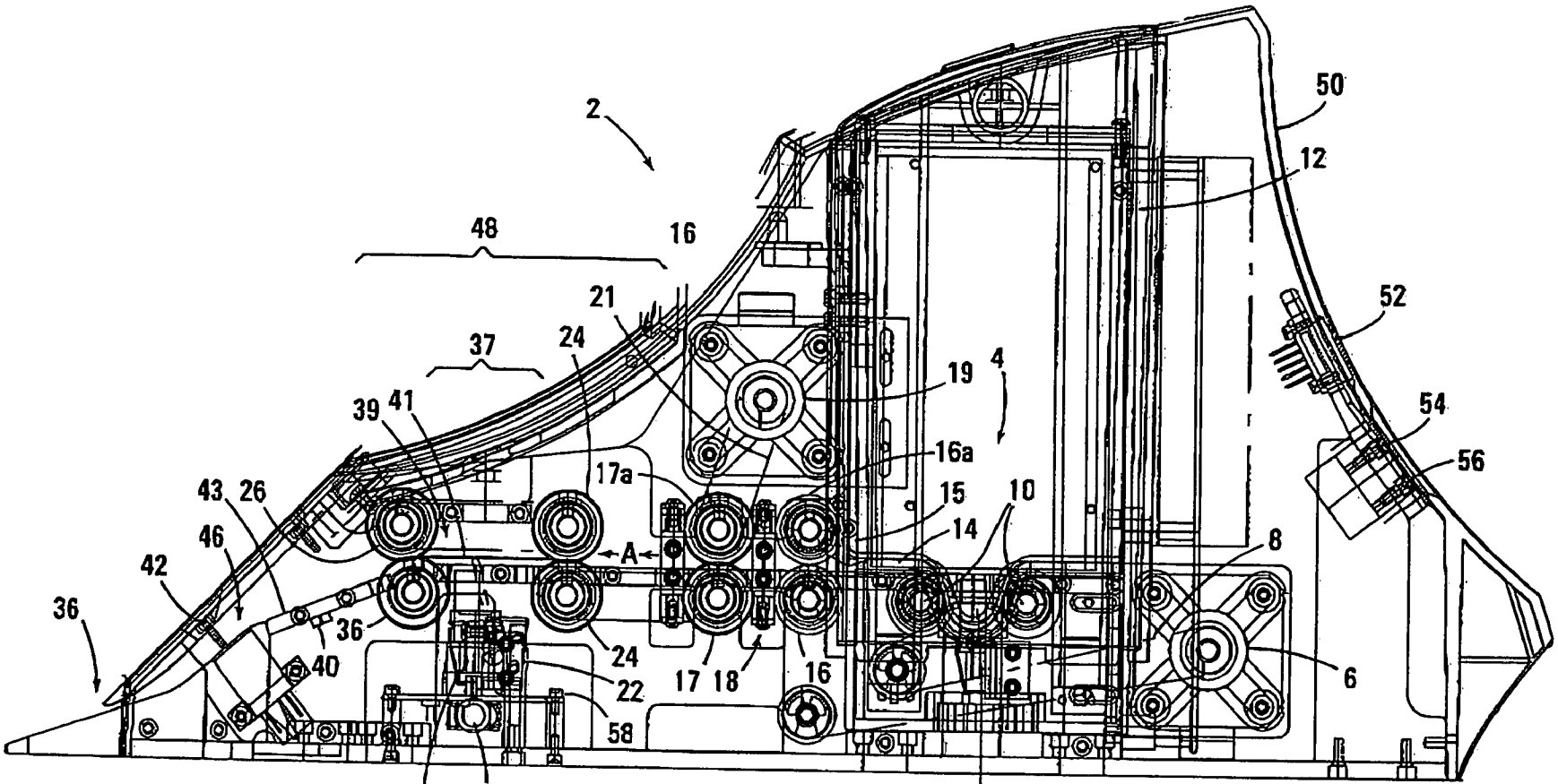
FIG. 1 shows a cutaway view of the side of a dealing shoe according to the invention.

A dealing shoe incorporating the scanning system of the present invention is shown in FIG. 1 and is useful in monitoring the play of casino table games such as blackjack (or Twenty-One) and Baccarat. The mechanical shoe provides additional functions without greatly increasing the space on the casino table top used by a conventional, simple dealing shoe. The detailed construction of an exemplary mechanized shoe can be found in co-pending applications Ser. No. 10/622,321, filed Jul. 17, 2003, in application Ser. No. 10/915,914 and application Ser. No. 10/958,208 filed Oct. 4, 2004. The content of these three applications is hereby incorporated by reference in their entirety.

The shoe provides cards securely to a delivery area and can read the cards in one or more various positions within the shoe, including, but not exclusively a) as they are withdrawn, b) before they are actually nested in the card delivery area, or c) when they are first nested in the card delivery area. The card reading information is either stored locally or transferred to a central computer for storage and/or evaluation. The cards according to this embodiment may be, but are not required to be mechanically transferred from a point of entry into the dealing shoe to the card delivery area, with a buffer area in the path where at least some cards are actually held for a period of time. The cards are preferably read before they are delivered into the card delivery area.

Figure 2:
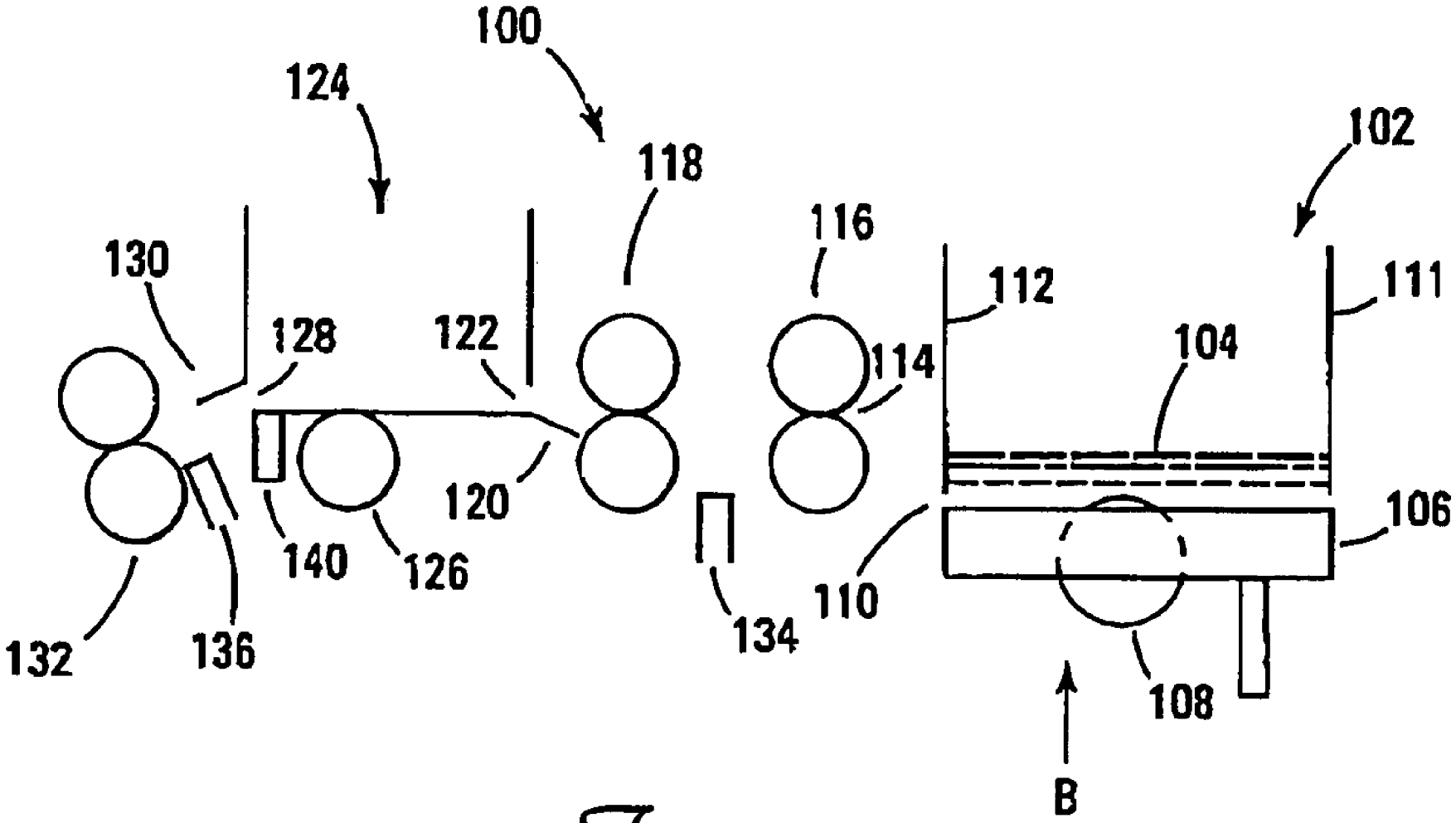
FIG. 2 shows a schematic section of the dealing shoe having the card reading and buffer area.
Figure 3:
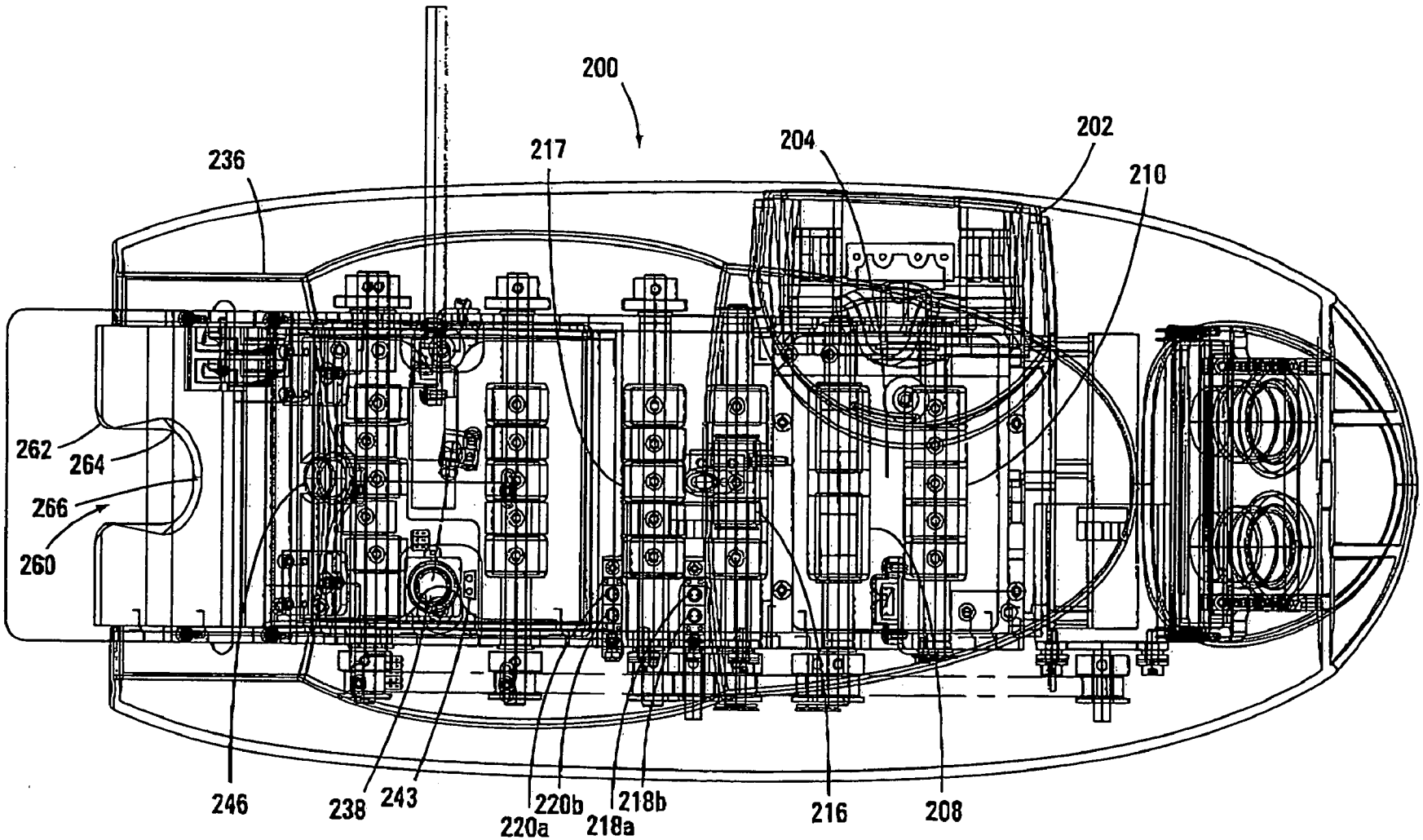
FIG. 3 shows a top cutaway view of one embodiment of a dealing shoe of FIG. 1 according to the present invention.

Reference to FIGS. 1-3 will help in an appreciation of the nature and structure of one embodiment of the card delivery shoe of the invention that is within the generic practice of the claims and enables practice of the claims in this application. FIG. 1 shows a card delivery shoe 2 according to the present invention. The card delivery shoe 2 has a card infeed or card input area 4 that is between a belt driving motor 6 and the rear panel 12 of the card delivery shoe 2. The belt driving motor 6 drives a belt 8 that engages pick off rollers 10. These pick off rollers 10 pick off and move individual cards from within the card infeed area 4. A belt driving motor 6 is shown but other motor types such as gear drives, axle drives, magnetic drives and the like may be alternatively used. The pick off rollers 10 drive individual playing cards (not shown) into gap 14 having a deflector plate 15 to direct cards individually through the gap 14 to engage brake rollers 16. The brake rollers 16 control the movement of individual cards past the rear panel 12 and into the card staging area 34. The braking rollers 16 are capable of becoming free-turning rollers during a card jam recovery process so that little or no tension is placed on a card as it is being moved by the system or manually to free a jam. A simple gear release or clutch release can effect this function.

Speed up rollers 17 apply tension to a card to move it more deeply into the card staging area 34. The speed up rollers can and may turn faster then the braking rollers 16, and the speed up rollers 17 may be driven by a separate motor 19 and belt drive 21. A card path and direction of movement A is shown through the card storage area 34. As individual cards are passed along the card path A through the card storage area 34, there are card presence sensors 18, 20, and 22 located at various intervals and positions to detect the presence of cards to assure passage of cards and/or to detect stalled or jammed cards. The path A through the card storage area 34 is in part defined by speed-up rollers 17 or rear guide rollers 24 and forward guide rollers 26 which follow the brake rollers 16 and the speed up rollers 17. One form of a buffer area 48 is established by the storing of cards along card path A. As cards are withdrawn from the delivery end 36 of the delivery shoe 2, additional cards are fed from the buffer area 48 into the card feed chute 46 into the delivery end 36.

It is always possible for cards to jam, misalign or stick during internal movement of cards through the dealing shoe. There are a number of mechanisms that can be used to effect jam recovery. The jam recovery may be based upon an identified (sensed) position of jam or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the dealing shoe (e.g., between and inclusive of rollers 16 and 17 will be discussed from an exemplary perspective, but the discussion relates to all other positions within the device.

If a card is sensed (e.g., by sensors 18 and/or 20) as jammed between rollers 16 and 17 (e.g., a jam occurs when cards will not move out of the position between the rollers and cards refuse to be fed into that area), one of a various number of procedures may be initiated to recover or remove the jam. Among the various procedures that are discussed by way of non-limiting examples include at least the following. The rear-most set of rollers (16 and 16*a*) may reverse direction (e.g., 16 begins to turn clockwise and 16*a* begins to turn counterclockwise) to remove the jammed card from between the rollers (16 and 16*a*) and have the card extend backwards into the space 14, without attempting to reinsert a card into the stacking area 4. The reversed rotation may be limited to assure that the card remains in contact with the rollers 16 and 16*a*, so that the card can be moved back into progression through the dealing shoe. An optional part of this reversal can include allowing rollers 17 and 17*a* to become free rolling to release contact and tension on the card during the reversal. The reversed rotation may be smoothly run or episodic, attempting to jerk a jammed card from its jam position. If that procedure does not work or as an alternative procedure, both sets of rollers 16 and 17 may reverse at the same time or in either sequence (e.g., 16 first or 17 first) to attempt to free the jam of a card. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 16, 16*a* and 17, 17*a*) can act in coordination, in sequence, in tandem, in order, independently or in any predefined manner. For example, referring to the roller sets as 16 and 17, the recovery process may have the rollers act as a) (16-17) at the same time in the same direction), b) (16-17) at the same time in the opposite directions to assist in straightening out cards, c) (16 then 17) to have the rollers work sequentially, d) (17 then 16) to have the rollers work in a different sequence, e) 16 only for an extended time, and then 17 operating alone or together with 16, f) 17 only for an extended time or extended number of individual attempts and then 16 for a prescribed time, etc. As noted earlier, a non-active roller (one that is not attempting to drive or align cards) may become free-rolling during operation of another roller.

These various programs may be performed at a single jam location in series or only a single program for jam recovery may be effected. In addition, as the card may have been read at the point of the jam or before the jam, the rank and value of the card jammed may be identified and this can be displayed on the display panel on the dealing shoe, on the central computer or on a shuffler connected to the dealing shoe, and the dealer or pit boss may examine that specific card to make certain that no markings or damage has occurred on that card which could either cause further problems with the dealing shoe or shuffler or could enable the card to be identified when it is in the dealing position in the shoe at a later time. The casino pit employee can then correct any problem by replacement of that specific card, which would minimize down time at the card table. Also, if a jam cannot be recovered, the delivery shoe would indicate a jam recovery failure (e.g., by a special light or alphanumeric display) and the pit employee would open the device and remove the jam manually.

Individual playing cards (not shown) in one embodiment may be read at one or more various locations within the card delivery shoe 2. The ability to provide redundant reading at multiple read locations assures performance of the shoe, while other card delivery trays with read capability usually had a single reading position at the point where and when cards were removed from the shoe for delivery to players. For example, in the construction shown in FIG. 1, the card presence sensors 18, 20 and 22 may also have card rank and suit reading capabilities, and other card reading sensors may be present as elements 32, 40 and 42. Element 38 may be optionally present as another sensing element or a card value (and possibly suit) reading element without the presence of sensor 22 or in combination with sensor 22. When the sensor 38 functions as a card reading element, cards can be read the cards as they are positioned into the car pre-delivery area or card buffer area 37, rather then as the cards are removed from the card delivery end 36.

Information may be read by the card reading sensor 38 by either continuous reading of all image data in the card pre-delivery area or by triggered on-off imaging of data in a specific region of cards 39 as a card 41 is within the pre-delivery area 37. For example, card presence sensor 22 may activate sensor 38. This sensor is preferably a CIS sensing array including an optical position sensor, a logic board and a FPGA. Alternately, the sensor can be a camera. A light source (not shown) may be provided to enhance the signal to the sensor 38. That specific region of cards is preferably a corner of the card 41 wherein complete value information (and possibly suit information) is readable on the card, such as a corner with value and suit ranging symbols on the card. That region could also be the entire face of the card, or at least ½ of the card (lengthwise divided). By increasing the area of the region read more processing and memory is required, but accuracy is also increased. Accuracy could also be increased, by reading the upper right hand corner of the card and lower left hand corner, since both of those locations contain the rank and suit of the card.

By reading the same rank and suit information on two locations on the card, errors due to defects or dirt on the card can be circumvented. By using position triggers and single line imaging of each card 41, the data flow from the sensor/card reading element 38 is minimized and the need for larger memory and data transmission capability is reduced in the system. Information may be transferred from the card reading elements (e.g., 32) from a communication port or wire 44 shown for sensor/reading element 32. Cards may be buffered or staged at various points within the dealing shoe 2, such as where restrained by rollers 26 so that cards partially extend towards the chute 46 past the rollers 28 on plate 43, or staged between rollers 24 and 26, between rollers 17 and 24, between rollers 16 and 17 and the like. Cards may partially overlap in buffering as long as two or more cards are not present between a single set of nip rollers (e.g., 26 and 27) where nip forces may drive both cards forward at the same time.

Other variations are available and within the skill of the artisan. For example, rear panel 12 may include a display panel thereon for displaying information or data, particularly to the dealer (which information would be shielded from players as the rear panel 12 would primarily face the dealer and be shielded from players' view). A more ergonomic and aesthetic rear surface 50 is shown having a display 52 that is capably of providing alphanumerics (letters and numbers) or analog or digital images of shapes and figures in black-and-white or color. For example, the display may give messages as to the state of the shoe, time to number of cards dealt, the number of deals left before a cut card or virtual cut card is reached (e.g., the dealing shoe identifies that two decks are present, makes a virtual cut at 60 cards, and based on data input of the number of players at the table, identifies when the next deal will be the last deal with the cards in the shoe), identify any problems with the shoe (e.g., low power, card jam, where a card is jammed, misalignment of cards by rollers, and failed element such as a sensor), player hands, card rank/suit dispensed, and the like. Also on the rear surface 50 are two lights 54 and 56, which are used to show that the shoe is ready for dealing (e.g., 54 is a green light) or that there is a problem with the dealing capability of the shoe (e.g., 56 is a red light). The memory board 58 for the card reading sensor 38 is shown with its information outlet 44 shown.

There are significant technical and ergonomic advantages to the present structure. By having the card infeed area 4 provide the cards in at least a relatively vertical stack (e.g., with less then a 60° slope of the edges of the cards away from horizontal), length of the delivery shoe 2 is reduced to enable the motor driven delivery and reading capability of the shoe in a moderate space. No other card delivery shoes are known to combine vertical card infeed, horizontal (or approximately horizontal ±40° slope or ±30° slope away from horizontal) card movement from the infeed area to the delivery area, with mechanized delivery between infeed and delivery. The motor drive feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying the game.

FIG. 2 shows an alternate embodiment for internal card buffering and card moving elements of the card delivery tray 100. A card infeed area 102 is provided for cards 104 that sit between walls 111 and 112 on elevator or stationary plate 106 which moves vertically along path B. A pick-off roller 108 drives cards one-at-a-time from the bottom of the stack of cards 104 through opening 110 that is spaced to allow only one card at a time to pass through the hole 110. The individual cards are fed into the nip area 114 of the first speed control or guide rollers 116 and then into the second set of speed control or guide rollers 118. The cards (one-at-a-time) passing through rollers 118 are shown to deflect against plate 120 so that cards flare up as they pass into opening 122 and will overlay any cards (not shown) in card buffer area 124. A second pick-off roller is shown within the buffer area 124 to drive cards one-at-a-time through opening 128. The individual cards are again deflected by a plate 130 to pass into guide rollers 132 that propels the cards into the delivery area (not shown) similar to the delivery area 36 in FIG. 1. Card reading elements may be positioned at any convenient point within the card delivery element 100 shown in FIG. 2, with card reading elements 134 and 136 shown as exemplary convenient locations.

FIG. 3 shows a top cutaway view of the dealing shoe 200 of an embodiment of the present invention. A flip up door 202 allows cards to be manually inserted into the card input area 204. The sets of pick-off rollers 208 and 210 are shown in the card input area 204. The position of the sensors 218*a* and 218*b* and 220*a* and 220*b* are shown outwardly from the sets of five brake rollers 216 and five speed up rollers 217. The sensors are shown in sets of two sensors, which is an optional construction and single sensors may be used. The dual set of sensors (as in 220*a* and 220*b*) are provided with the outermost sensor 220*b* providing simply sensing card presence ability and the inner innermost sensor 220*a* reads the presence of card to trigger the operation of the camera card reading sensor 238 that reads at least value, and optionally rank, and suit of cards. The sensor 220*a* alternatively may be a single sensor used as a trigger to time the image sensing or card reading performed by a card sensing system of the present invention or alternatively a camera 238 as well as sensing the presence of a card. An LED light panel 243 or other light providing system is shown present as a clearly optional feature. A sensor 246 at the card removal end 236 of the shoe 200 is provided. The finger slot 260 is shown at the card delivery area 236 of the shoe 200. The lowest portion 262 of the finger slot 260 is narrower then the top portion 264 of the finger slot. The walls 266 may also be sloped inwardly to the shoe and outwardly towards the opening 260 to provide an ergonomic feature to the finger slot 260.

The term camera as generally used herein is intended to have its broadest meaning to include any component that accepts radiation (including visible radiation, infrared, ultraviolet, etc.) and provides a signal based on variations of the radiation received. This can be an analog camera or a digital camera with a decoder or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert radiation signals to information that can identify the suit/rank of a card from the received signal. The term camera is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

There are a number of independent and/or alternative characteristics of a mechanical delivery shoe that are believed to be unique in a device that does not shuffle, sort, order or randomize playing cards.

1) Shuffled cards are inserted into the shoe for dealing and are mechanically moved through the shoe but not necessarily mechanically removed from the shoe.
2) The shoe may optionally mechanically feed the cards (one at a time) to a buffer area where one, two or more cards may be stored after removal from a card input area (before or after reading of the cards) and before delivery to a dealer accessible opening from which cards may be manually removed.

3) An intermediate number of cards are positioned in a buffer zone between the input area and the removal area to increase the overall speed of card feeding with rank and/or suit reading and/or scanning to the dealer.
4) Sensors indicate when the dealer accessible card delivery area is empty and cards are automatically fed from the buffer zone (and read then or earlier) one-at-a-time.
5) Cards are fed into the dealer shoe as a vertical stack of face-down cards, mechanically transmitted approximately horizontally, read, and driven into a delivery area where cards can be manually removed.
6) Sensors detect when a card has been moved into a card reading area. Signal sensors can be used to activate the card reading components (e.g., the camera and even associate lights) so that the normal symbols on the card can be accurately read.

With regard to triggering of the camera or imager, a triggering mechanism can be used to set the camera to shoot at an appropriate time when the card face is expected to be in the camera focal area or image plane or location. Such triggers can include one or more of the following, such as optical position sensors within an initial card set receiving area, an optical sensor, a nip pressure sensor (not specifically shown, but which could be within either nip roller (e.g., 16 or 17), edge sensor, light cover sensor, and the like. When one of these triggers is activated, the CIS line sensor and position sensor, or alternatively a camera is instructed to time its shot to the time when the symbol containing corner of the card is expected to be positioned within the camera focal area. The card may be moving at this time and does not have to be stopped. The underlying function is to have some triggering signal in the device that will indicate with a sufficient degree of certainty when the symbol portion of a moving or moved card will be with the imager's focal area. A light associated with the imager may also be triggered in tandem with the camera or imager so as to extend the life of the light and reduce energy expenditure in the system.

One preferred embodiment of the delivery shoe, its methods and apparatus may be generally defined as card delivery shoe having a storage end and a delivery end. The shoe stores a first set of cards in the storage end and allows manual removal of cards from the delivery end. There may be at least one first sensor in the delivery end that senses when a card is absent from the delivery end. The sensor provides a signal (to some intelligence or signal receiving function) and a signal or power is provided to a motor so that a card is delivered to the delivery end. A motor mechanically delivers a card to the delivery end of the shoe as a result of the initial sensing of the absence of any card from the delivery end, especially where the card may be manually removed from the delivery end. The card delivery shoe of card may also have at least one sensor reads card values in the card delivery shoe before a card that is read is stationery in the card delivery end or as the card is withdrawn from the delivery end.

An alternative way of describe other embodiments of the invention include a description as a playing card delivery shoe from which cards may be dealt comprising a) an area for receiving a first set of cards;
b) first card mover that moves cards from the first set to a card staging area wherein at least one card is staged in an order by which cards are removed from the first set of and moved to the card staging area;
c) second card mover that moves cards from the card staging area to a delivery area wherein cards removed from the staging area to the delivery shoe are moved in the same order by which cards were removed from the first set of cards and moved to the card staging area; and
d) card rank and/or suit reading sensors that read at least one element of information of card rank, card suit or card value of each card separately after each card has been removed from the area for receiving the first set of cards and either before removal from the card delivery area or as they are removed from the shoe in the delivery tray area.

The shoe may optionally a maximum capacity of at least one card but less then an entire deck of cards present in the staging area. Preferably from 1 to 2 cards are present in the staging area, most preferably only one card is present. After completion of card reading of at least one card in step d), a system of comparison may be present to compare the suit and rank of the at least one card to expected card information. The expected card information may be present in a memory storage component in the shoe or external computer for each shuffled set of cards inserted in the area for receiving a shuffled set of cards. The memory storage area may also be in a central computer and read information from the shoe is relayed to the central computer for comparison. The system of comparison may be present to compare the suit and rank of the cards read in step d) with the expected card information for each shuffled set of cards inserted in the area for receiving a shuffled set of cards. The at least one information is read by the device before the card is being removed from the storage device. Preferably, the first set of cards comprises a shuffled set of cards.

Certain aspects of the invention may alternatively be described as a card storage shoe comprising a card infeed area where an approximately vertical set of cards can be seated. The shoe could have a card moving element that moves one card at-a-time from the approximately vertical set of cards. There could be an automatic mechanical transporting system for horizontally transporting individual ones of cards moved from the vertical set of cards to a card delivery area. There is preferably (but optionally) a card reading system that reads at least one of suit, rank and value of cards before read cards become stationary in the card delivery area. In one embodiment, a buffer area is present between the card infeed area and the card delivery area and at least some cards remain stationary for a time in the buffer area before being delivered to the card delivery area. Cards may be read, for example, entering or while stationery in the buffer area. It is one embodiment to have only one card present in the card buffer area at any time. It is one aspect of an embodiment of the invention for cards to be read in the shoe after they leave the card buffer area but before they are completely stationary in the card delivery area. They may be read when stationery in the card buffer area, but not in the card delivery area. There may be more than one sensor present along a path between the card infeed area and the card delivery area to detect the presence of cards at specific locations.

There may be design and function reasons in certain embodiments to have a sensor-reader (e.g., a camera or any other form of image detector) read cards discontinuously when the sensor-reader is triggered by a card detection sensor in the shoe.

A method is available for providing a card to a dealer for manual delivery of the cards by a dealer, the method comprising:

placing a set of cards within a card infeed area;

mechanically moving cards from the set of cards from the card infeed area to a card delivery area where at least some cards become stationary; and reading individual cards for at least one of rank, suit or value after the cards are removed from the card infeed area and before the cards become stationary in the card delivery area.

The method may have the set of cards is placed in an approximately vertical stack in the card feed area. At least one card from the set of cards may be moved to a buffer area between the infeed area and the card delivery area, and at least one card may remain stationary within the buffer area until the card delivery area is sensed to be empty of cards. The at least one card that remains stationary in a buffer area may remain in the buffer area until a signal generated from the shoe indicates that at least one card is to be moved from the buffer area to the card delivery area. The method may be generated by a sensor in the card delivery area indicating that an additional card is desired in the card delivery area. The signal may be generated by a sensor in the card delivery area indicating that no cards are present in the card delivery area.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still (stationary) at a particular location within the shoe.

Simple Baccarat Card Delivery Shoe with Scanner

An alternate use of the scanning system of the present invention is in combination with a dealing shoe lacking mechanical card-moving components to move cards. Such a shoe includes an enclosure for containing a set of cards, the enclosure including a sloping lower surface and a wedge-shaped moveable body supported by the sloping surface that urges cards towards a card-delivery end of the device. Such a standard style shoe may be provided with an imaging system described herein and additional processing capability to monitor and control a card game such as Baccarat. In other applications, the data generated by the FPGA may be downloaded into local storage or transmitted via a network connection to network storage.

Figure 8:
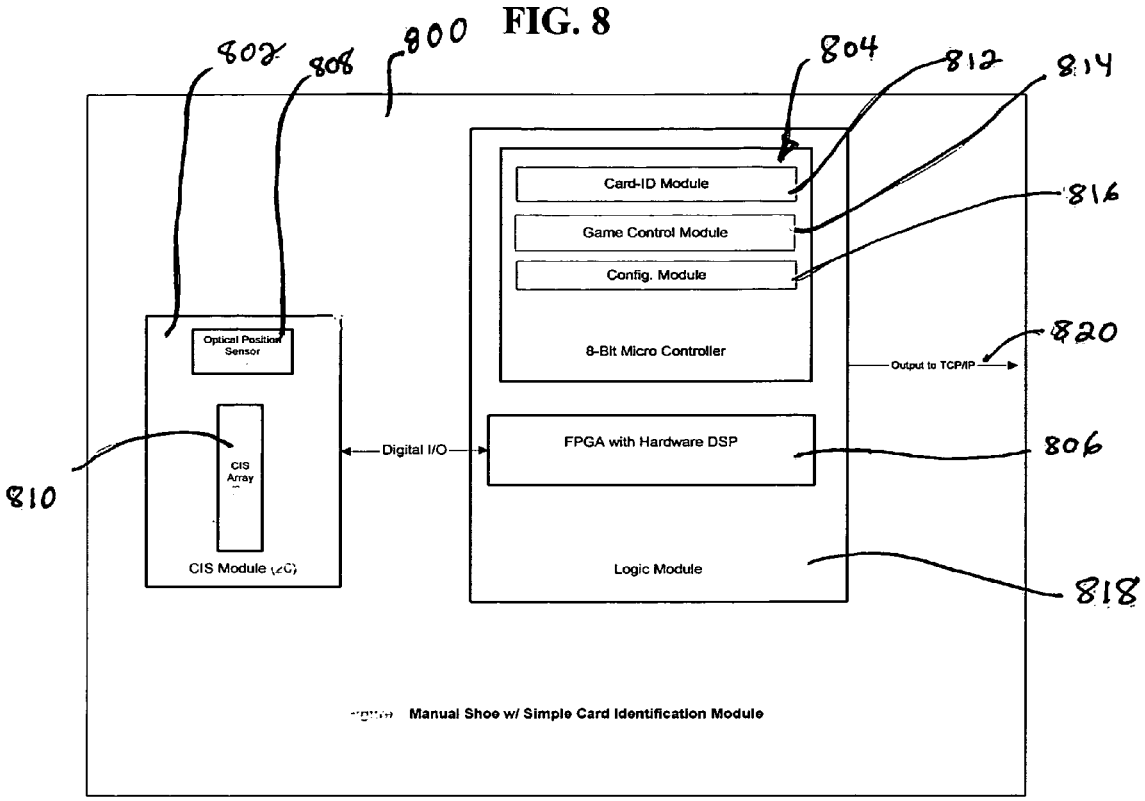
FIG. 8 is a diagram showing a scanning system of the present invention incorporated into a dealing shoe with intelligence capable of controlling a game of Baccarat.

As shown in FIG. 8, a control system 800 of a simple card dealing shoe used to monitor the game of Baccarat, for example, is shown. A sensing system of the present invention is preferably located near the exit end of the shoe. As cards are removed from the shoe face-down, the area of the cards bearing rank/suit information is line scanned. This sensing system replaces known systems using a camera and an external mini PC.

In addition to providing a CIS sensing array 810, the position sensor 808, and the FPGA 806, there may be, for example, an 8-bit microcontroller 804 and both the microcontroller 804 and the FPGA 806 may both reside on the same logic module 818. There are preferably three software modules that reside on the microcontroller 804, they are:

The Card-ID module 808 that reads the output of the FPGA 806 and transmits or saves the data as appropriate per game rules.

The game control module 814 that can have the capability of reconstructing the hands and determining the outcome of each round. This information is sent out from the logic module 818 as the shoe output 820 via the TCP/IP communication port or by means of serial port, Zigbee or other communication method.

The Configuration module 816 is provided preferably with imbedded web server software (not shown) that gives the user the capability to change the configuration of the Baccarat Hand Reconstruction module, as well as options for the shoe remotely through a web browser.

Communication between the CIS module 802 and logic module 818 in one form of the invention is via a digital I/O port. In other forms of the invention, data is communicated via hard wire, via wireless connection, via network connection or any other known communication method.

Some background information on the game of Baccarat and systems for monitoring the game is useful in understanding how the sensing system of the present invention can be used. Baccarat is one of the many live table games played in casinos or gaming establishments. Baccarat uses a standard deck of 52 playing cards and is usually dealt from a shoe having multiple decks that have been shuffled together prior to the beginning of play. Poker is usually dealt from a single deck of cards, and blackjack (Twenty-One) is dealt from at least one deck, with up to eight or more decks in a shoe being in common use.

One set of individual and/or collective primary purposes of the reading of suit and rank content of the dealing shoe is to enable:

1) The shoe to read the cards, either as being dealt (as they leave the shoe) and/or as they are fed into the dealing chamber of the shoe.
2) Based on fixed rules of blackjack, poker or Baccarat, which are simple and readily treated by algorithms and mathematic formulae, Wins/Losses on each round of play can be determined.
3) The information (rank) relating to the cards read by the dealing shoe is provided to a processor and the value of each hand is determined.
4) The Win/Loss information can be used to display the winning results on a board and to determine Wins/Losses.
5) The data from the dealing shoe can transferred and processed in real time or transferred and analyzed or processes at a later date.

A card-reading dealing shoe (either Mechanized or not) for use with the casino table card games may be integrated with other components, subcomponents and systems that exist on casino tables for use with casino table games and card games. Such elements as bet sensors, progressive jackpot meters, play analysis systems, wagering analysis systems, player comping systems, player movement analysis systems, security systems, and the like may be provided in combination with the baccarat shoe and system described herein. Newer formats for providing the electronics and components may be combined with the baccarat system. For example, new electronic systems used on tables that provide localized intelligence to enable local components to function without absolute command by a central computer are desirable.

One distinct advantage of the card sensing system of the present invention is that the system does not require central processing capability to perform the card identification function. The concept of operative control among processing units should be appreciated to appreciate the performance of the present invention as well as to comprehend differences between the practice of the present invention and conventional processing apparatus used in the gaming industry. The most important concept is that most existing systems perform by a single local table processor sending commands to peripherals to perform specific functions. For purposes of discussion, the initial main emphasis of the description will be directed towards the performance of a casino table card game gaming apparatus. This emphasis is not intended to narrow the scope of the invention, but is rather intended to simplify the description.

As can be seen, even where there is some processing intelligence distributed around a gaming table, the underlying operation of the system remains a command and response structure, which both requires high component costs and limits the extensibility and scalability of the system. A gaming system with different architectural structure would be desirable if it could reduce costs and add flexibility to the system and enable ease of component replacement.

In one live table game monitoring system, multiple intelligent data collection modules, each acting as a finite state machine are each communicatively interconnected with a sensing device to collect data, date stamp the data and send it to a central data repository via a network connection. The processing unit, referred to in this application as a "G-Mod" in one example of the invention is a microprocessor with associated memory that is capable of being programmed. In another form, the G-Mod is a hard wired as a FPGA (field programmable gated array). The G-Mod performs data acquisition, date stamps and sends sensed data via a local table network such as a table-specific Ethernet or via a simple communication channel, Zigbee, mesh network communication, etc. or by other known means to an external computer via a casino computer network that contains a database.

The sensing system of the present invention can be used as a sensor-G-Mod pair for transmitting data via an Ethernet connection on a table-based network, directly to casino network storage via a network connection or to local storage. In contrast to systems that provide an exclusive main computer to command all or most individual sensors and peripherals, in the presently described technology, the G-Mod's detect activity in the sensors and peripherals. The G-Mod's date stamp and broadcast the information over a local table Ethernet or communications channel to a central database. One preferred mode of communication is UDP but others such as TCP, TCP/IP, RS-485, via databus, etc. are alternate communication protocols. In a preferred form of the invention, the G-Mod's broadcast information over a network but do not cause other G-Mod's to perform operations. Less powerful techniques (as compared to typical main processor systems used in gaming apparatus) may be distributed to monitor each peripheral. The use of these separate intelligences for each peripheral eliminates the need to reprogram old modules as new modules are added, and allows the manufacturer to offer customized hardware and software packages capable of collecting only the information that the casino operator wants to collect.

Casino table card games can be provided with a wide variety of sensors. One such sensor is for detection of a beginning or final completion of a round of play of a casino table card game. The sensor is read by the distributed intelligence table subcomponent (a G-Mod) that has a time/dating capability. The signal is time/date stamped (referred to herein as "Date Stamping" or "date stamping" for simplicity. The date stamped data is then transmitted generally through a communication line to an external computer that contains database management software and a database interface. The data can be accessed by programs used to analyze the data, if needed. The database interface allows casino management to extract the data in a usable form. The collected data retains its date stamping at least through storage, analysis, data entry or other treatment of the data after transmission away from the table, and the date stamping is typically provided by the separate intelligence, although in some cases may or may not be provided by the sensor itself.

Other components of a casino table gaming apparatus might include a coin acceptor, bill validator, a drop box capable of sensing the input of currency, ticket in/ticket out sensing/reading, lighting, video displays, card reading sensors, chip counters, security sensing, dealer input controls, player input controls, dealer identification card scanning, player tracking, round counting, hand counting, shuffle counting and the like. In the present technology described herein, a round counting system is also described, wherein the number of rounds of plays are determined (one round at a time) by a determination of when a dealer's play has been completed, as by complete removal of cards from the dealer's position.

In the practice of the presently described technology, communication to a data collection system with at least some peripherals is performed by general broadcast communication of game status (which may also be referred to as generated information or data) over a table-specific network, such as an Ethernet, from more than one distributed intelligence sources within the system, each of which is associated with at least one peripheral or sensor. Each distributed intelligence (a local processor) sends its own game status communication over the network, but does not respond to game status information of other G-Mod's. Each local processor (hereinafter G-Mod)) is capable of sending date stamped information to a database where the information is stored and can be accessed by the same computer that holds the database or by another external computer. This is a significant element in the practice of the invention, that information may be generally sent (essentially at the same time as a single, generally dispersed signal) over a network from multiple distributed intelligences.

For example, in the description given above for the insertion of a coin into the coin acceptor, when a coin is inserted in the system of the invention, the data is time stamped and send via an Ethernet network to a database collection system. As other G-Mod monitored activities occur, additional information is transmitted to the data collection system, independent of when/where other data is being collected and transmitted.

In one form of the invention, the state of each G-Mod is broadcast over a network that contains all of the sensors and G-Mod's associated with one gaming table. As the state of each G-Mod changes, the signals being broadcasted to all of the G-Mod's is changed, and each G-Mod independently transmits information to the central data collection point.

One conceptual way of visualizing or understanding a method of implementing an intelligence system for the operation of a gaming system according to the present invention is as decomposing the tasks of previous constrained (central processor commanded) systems into orthogonal or unrelated sensing events running on independent processors. The term "orthogonal" for purposes of this disclosure means no commonality in function. The provision of orthogonal or independent intelligence functionality and individual performance capability allows the various system components to operate independently, and timely transfer the date stamped data to a database for further processing. Such a system functions more efficiently because there is no central processor prioritizing the execution of functions.

As noted above, there are many different elements of the gaming system that can be considered as peripherals or data acquisition devices. Some more important examples of table-game related peripherals include: bet presence, bet recognition, bet separation, card identification, card tracking, player tracking and employee tracking. Other components might include (in addition to those described above) multimedia processing, stepper motor control, random number generation, I/O detection and response, audio signals, video signals, currency handling, coin acceptors, bill acceptors, paperless transactions, ticket-in and ticket-out crediting, security systems, player accounting functions, door locks, signal lighting (change/assistance), player input (e.g., button controls, joy sticks, touch screens, etc.) and any other functions that my be provided on the gaming apparatus.

The units (which may be elsewhere referred to herein as gaming modules or G-Mod's) are operated substantially independently of each other, although some interdependencies could exist. In the event of interdependencies, they are not subject to the classic control model but operate by finite state machine changes that are broadcasted and then react with intelligence. For purposes of this disclosure, the term "finite state machine" (or FSM) is a theoretical device used to describe the evolution of an object's condition based on its current state (or condition) and outside influences. The present state of an object, its history, and the forces acting upon it can be analyzed to determine the future state of an object. Each state then may have a "behavior" associated with it. An FSM is a very efficient way to model sequencing circuits and events. Ultimately the game is nothing more than a complex sequencing unit, branched as appropriate for the game function. All finite state machines can be implemented as hardware, software, or hardware and software running on a processor.

By assigning specific data collection controls to local architecture, the design of the system places system tasks into lower computing power manageable units. The manageable units (e.g., the peripherals) can then be each handled (or small groups handled) by dedicated controller modules. Some design care should be taken to combine control of peripherals under a single intelligence to assure that such accumulating demands for processing power are not being required as to merely reconstruct a main processor in a different physical location with the system. In the distributed intelligence structure, the G-Modules or individual intelligences have enough intelligence on board to handle the details of how the G-Mod itself handles the details of operation of the peripheral device.

Although the present invention sensor-G-Mod systems have been described largely in terms of a single round-counting module that sends date-stamped information to a central database, it is to be understood that multiple modules could be present in one system to send collected data to a data repository. In a preferred form of the invention, the date stamped data is broadcasted over a communication channel or an Ethernet specific to the table game, and that the data in this format is collected and recorded by the central data repository.

For example, a baccarat gaming table may be equipped with a round counting sensor and G-Mod pair and may also be equipped with a sensor at the output of the dealing shoe for counting cards dispensed from the shoe. This information can be used in combination with the round counting information to deduce the number of cards dealt in a given round of play. If there are also bet present sensors (and associated G-Mod (s)) for the bet sensors, the number of hands played per round of play can also be determined. The modules may broadcast signals which causes a G-Mod to send date stamped bundles of information to the database, or may allow one module to influence the operation of another module.

Each G-mod is collecting, date stamping and transmitting data as the data is collected from the table to a central database, but the G-Mod's are not commanding the operation of one another. Instead, they are merely causing state changes in the other modules. The database does not issue commands to the G-Mod's, except to reset, reboot and send and receive configuration information. In effect, each G-Mod is a free-standing microprocessor that runs independently of the any other intelligence, except that it receives limited operational information from the database computer.

A card swipe module could be added to the table system, with an associated G-Mod. This G-Mod could not only transmit time-stamped data to the data repository, but could also transmit player I.D. information to the player tracking system residing in the casino computer system.

One or more sensors could sense information transmitted through an output data port of a shuffler, for example, or a keypad control used to issue commands to a shuffler. The shuffler can have it's own G-Mod (either internal or external) and is capable of transmitting date stamped information such as number of cards per hand, number of hands per hour, number of cards dispensed per unit time, number of cards re-fed into a continuous shuffler per unit of time, number of promotional cards dispensed per unit of time, etc. At the same time, another indicator attached to a G-Mod could transmit data stamped data about bonus awards granted at a certain time, and the like. This information could be collected in a central database.

A bet interface module could also be provided. Known collection techniques for wagering data include optical and metal detection type bet present sensors for fixed bets, and camera imaging, radio frequency/identification technology, bar code scanning, scene digitizing, laser scanning, magnetic strip reading and the like for measuring the amount of the bet, as well as the presence of the bet. Outputs from these measurement devices are fed through a dedicated G-Mod and the data is date stamped and delivered to the central data depository.

Another possible G-Mod controls a card reading camera or other sensing device such as a CIS card sensing system with similar functionality (reading rank and suit of a card, or just rank) located in the card shuffler, the dealing shoe, the discard tray, above the table or combinations of the above. Information about the specific cards dealt to each player could be obtained from the database by first feeding date-stamped information about cards dealt and returned into the database via the Ethernet.

In one form of the invention, the G-Mod sends date-stamped information to the database and an algorithm residing in the same computer or separate computer uses this information as well as round counting and betting information to determine the composition of a hand of blackjack, for example.

Another G-Mod is in communication with an i.d. system for tracking the movement of employees in and out of the pit, or more preferably when the dealers arrive at and leave the table. This information is collected and reported by the dealer G-Mod into the database, and then reports can be generated that combine this information with rounds of play per hour to determine which dealers deal the most hands in a given period of time.

It is noteworthy that in a preferred form of the invention, all of the G-Mod's are in communication with the same database, all though separate databases may be established for distinct data sets. Also, data repository does not issue commands to the G-Mod's, with the exception of requesting configuration data and resetting/rebooting the G-Mod's. The central database merely organizes the data in a manner that allows for easy access by external computers or another application program residing on the same computer as the database. In this respect, the G-Mod's are self-executing and do not require central intelligence to perform their individual functions. The data may be analyzed and used to make decisions about awarding redeemable points and free rooms to players, etc., scheduling pit labor, promoting pit personnel, closing and opening tables, determining optimal betting limits for given periods of time and other important managerial functions.

Each G-Mod may be in data communication with an interface device such as one or more specialized circuit boards to allow the data from multiple G-Mod's to be fed into a standard port of the computer that serves as the data repository. Also, multiple sensing modules may be fed into a single G-Mod if the particular G-Mod has the capacity to process the extra information.

A software interface can be provided to directly access data in the data repository and to manipulate and organize the data so that it can be outputted onto a display, written report or formed into a data stream so that the data can be further manipulated. In one example of a software interface program, the operator can obtain reports of rounds of play per hour per actual table, per pit, or per property, as determined by the user.

The information in the form of a data stream may be further analyzed. In one example, the data is fed into a host computer or can be analyzed in the same computer system where the database and interface resides or on a host computer. For example, the data from one or more of the round counting module, the shoe sensor, the card swipe, card reading module, the shuffler data port sensor, and the bet interfaces can be used to create a report of rounds played per unit of time, the number of players at the table per unit of time, the number of hands played at each round, the maximum bet per player in a given unit of time, the average bet per player in a unit of time, the number of shuffles per unit of time, the number of cards removed from and placed into the shuffler in a unit of time, hand composition and other information considered important to the casino manager.

Because all of the G-Mod's work independently, the casino operator can choose the modules and resulting data that is most important to them for a given environment, and only purchase those modules. For example, one casino might want to reconstruct individual hands, track betting and associate the information with a particular player on a high stakes table, while tracking only rounds and the identification of the employees on low-stakes games.

By using a modular approach to intelligent data collection, only the equipment and reports that are wanted can be provided at the lowest possible cost. Since none of the G-Mod's are issuing direct commands to one-another, it is not necessary to rewrite any code when additional modules are added.

Applicants have discovered that there are potential inaccuracies in data that is transmitted prior to date/time stamping. When signals are stamped in by the main computer, this is merely indicative of when the signal arrived. Also by providing the stamping function at the receipt site (such as the main processor, or central gaming location), the information is more easily subject to manipulation or change by an operator. Also, when there is a line breakdown (e.g., some casinos may still use telephone line connections which can be busy or interrupted, or the communication system to the main computer breaks down), the accuracy of the stamping is adversely affected. The value of the data decreases in some necessary transactions and casino oversight if the time data is inaccurate. A gaming system with a different architectural structure and informational structure would be desirable if it could reduce these issues.

As noted earlier, round counting is one service or data component that can be important to a table. Round counting can be managed by a single sensor and G-Mod, and this function can be measured in games such as Baccarat by the associated processor recognizing that a sequence of events constitutes a round. For example, the game rules of Baccarat may be programmed into memory and when the last hit/stand decision is executed by the processor, the end of the round is recognized.

Round completion can be important for evaluating rates of play at tables, player rating, dealer performance, and even in resolving disputes over time of completion of hands at different tables or different casinos where priority might be an issue (as in competitive events or qualifying events).

Round counting requires some form of signal generation at a table that is indicative of approximate completion of a round and preferably absolute completion of a round. This can be done in a number of ways for signal generation, depending upon the game. For example, video cameras can be placed to observe the dealer's hand. When the motions of a dealer or the dealer's cards indicate that the dealer's cards have been removed from the playing area, a signal is sent "round completed" or "dealer's hand removed" or some functional equivalent.

A sensor can be placed on the table over which the dealer's cards are placed. It is preferred that this sensor not be as movement limiting as the sensor described in U.S. Pat. No. 5,803,808, where cards appear to have to be specifically fitted into at least a right angle abutment with a card reading ability. Upright extensions on the card table can interfere with card movement, can interfere with chip movement, can cause accidental disclosure of cards, and are generally undesirable. A sensing system with a relatively flat or slightly indented or slightly raised surface is more desirable. The system could comprise a transparent or translucent panel approximately flush with the table surface that allows light (e.g., ambient light or specially directed wavelengths of light for which a sensor is particularly sensitive) to pass to a sensor. The absence of light in the sensor for a predetermined period of time and/or intervals of time can be the original signals themselves, which are interpreted by an intermediary intelligence on the table that has the time sensing capability for evaluating the signal. The original signals are then time stamped before being forwarded to the central database and can be analyzed by accessing the collected data.

Particularly in games where batch shuffling is used, such as poker or even single deck blackjack, the signal could also be originated by cards being placed in a shuffler and a shuffling process initiated, the shuffler sending a start-shuffling signal to the date stamping component on the table. The dealer could even activate or press a button provided on the table, but this would tend to leave the results under the control of the dealer, who could manipulate the game to improve results, or who could suffer from forgetfulness.

These latter systems, unless they are completely electronic without any physical implementation (such as physical playing cards, dice, spinning wheel, drop ball, etc.) will need sensing and/or reading equipment (e.g., card reading for suits and/or rank, bet reading sensors, ball position sensors, dice reading sensors, player card readers, dealer input sensors, player input systems, and the like). These would be the peripherals in the table systems. Also, newer capabilities are enabled such as moisture detection (e.g., for spilled drinks), smoke detection, infrared ink detection (to avoid card marking), shuffler operation, dealer shoe operation, discard rack operation, jackpot meters, side bet detectors, and the like.

What is claimed:

1. A sensing apparatus for the determination of at least one of rank or suit of a playing card comprising: a line scanner capable of scanning a line crossing an area of a card representing rank and/or suit; a card position sensor; and a hardware component capable of receiving signals from the line imager and card position sensor, wherein the hardware component forms a vector set from the output from the imager, and compares the vector set to known reference vector sets by correlation in hardware logic circuits without running software to determine rank and suit of a card.

2. The apparatus of claim 1 wherein an output signal from the line scanner is at least one of voltage vs. time, binary data and gray scale data.

3. The apparatus of claim 1 wherein the line scanner comprises a contact image line sensing array and line scanning is initiated by signals from the card position sensor.

4. The apparatus of claim 1 wherein the hardware component is a FPGA or ASIC.

5. The apparatus of claim 1, wherein the card position sensor is selected from the group consisting of: a CIS sensing array, an optical sensor, ultrasonic sensor, capacitive sensor, inductive sensor, eddy current sensor and microwave sensor.

6. The apparatus of claim 1 and further comprising correlating the vector set with known reference vector sets to identify the at least one of a suit or rank of the playing card.

7. A dealing shoe capable of determining at least one of a rank and value of cards, comprising: a housing for holding cards to be dealt; an output opening for removal of cards from the housing; and a sensing system of claim 1 located proximate the output opening.

8. The dealing shoe of claim 7, and further comprising a logic module capable of controlling the game of Baccarat, the logic module comprising: a hardware component; and a microcontroller, the microcontroller comprising: a card ID module; a game control module and a configuration module.

9. The dealing shoe of claim 7, and further comprising a card moving mechanism for moving cards from an infeed area to the output opening, wherein cards are sensed before reaching the output opening.

10. An apparatus according to claim 1 comprising a playing card delivery shoe for use in the play of the casino table card game of at least one of baccarat or blackjack from which delivery shoe cards may be dealt comprising a) an area for receiving a first set of playing cards useful in the play of the casino table card game of at least one of blackjack or baccarat; b) first card mover that moves playing cards from the first set to a playing card staging area wherein at least one playing card is staged in an order by which playing cards are removed from the first set of and moved to the playing card staging area; c) second playing card mover that moves playing cards from the playing card staging area to a delivery area wherein playing cards removed from the staging area to the delivery shoe are moved in the same order by which playing cards were removed from the first set of playing cards and moved to the playing card staging area; and d) playing card reading sensors that read at least one playing card value of each playing card separately; wherein there is a direct or indirect communication link between the playing card reading sensors and a processor, which processor analyzes said data according to rules of play of the game of at least one of blackjack or baccarat and determines results of play for a round of play based upon said data.

11. An apparatus according to claim 1 comprising a card delivery shoe for use in the play of baccarat or blackjack, the shoe having a storage end and a delivery end, the shoe storing a first set of cards in the storage end and allowing manual removal of cards from the delivery end, at least one first sensor in the delivery end that senses when a card is absent from the delivery end and sends a signal to a motor that a card is to be delivered to the delivery end, a card reading sensor, and a motor that mechanically delivers a card to the delivery end of the shoe, wherein there is a communication link between the card reading sensors and a processor, which processor analyzes said data according to rules of play of the game of baccarat or blackjack and determines results of play for a round of play of baccarat or blackjack based upon said data.

12. An apparatus for reading symbols from playing cards comprising: a contact image sensor line scanning array; and a card motion sensor, wherein the motion sensor triggers operation of the imager to provide vector signals from playing card symbols passed over the image system to hardware logic circuits that determine suit and rank without running software.

13. The apparatus of claim 12 and further comprising a hardware component capable of receiving input from the contact image line scanning array and the card motion sensor and determining at least one of a card rank and card suit.

14. The apparatus of claim 13 wherein the imager provides spaced line scans of the playing card symbols.

15. The apparatus of claim 14 wherein the signals are provided to an FPGA or ASIC to identify the at least one of a suit or rank of the playing card imaged while software is running on tasks other than determining rank and suit of a card.

16. An apparatus for reading symbols from playing cards comprising: a line imager that images at spaced intervals on playing cards in at least a region of the card where suit and rank symbols are provided on the playing cards; a card position sensor; and a hardware logic circuit component that receives data from the line imager and determines at least one of suit and rank of an imaged playing card without running software for the purpose of analyzing sensed data to determine rank and suit.

17. A method of identifying the rank and suit of a playing card comprising: automatically taking spaced line scans of rank and or suit symbols printed on a playing card to create operating signals relating to less than all of the area of the symbols; and hardware correlating the signals with known signals to identify the rank and suit by closest correlation of the scanned symbols and the known symbols without running software for the purpose of analyzing sensed data to determine rank and suit, wherein the operating signals comprise signals indicative of at least one of voltage vs. time, binary values and gray scale values within a range of gray scale values.

18. The method of claim 17 where the spaced line scans are triggered by motion or timing sensors operating when a playing card is moving.

19. A method for identifying suit and rank symbols on playing cards comprising: passing an area of a card bearing symbols on a playing card over a line scanner, taking at least one line scan of each symbol, providing a signal from the imager to hardware logic circuits that operates without running software to determine rank and suit, and the hardware identifying suit and rank of the playing card from the provided signals, wherein identifying suit and rank based from the provided signal comprises providing a signal indicative of at least gray scale values of the line image and the values are then converted to binary values.

20. The method of claim 19 wherein said imager comprises a contact image line scanning system.

21. The method of claim 19 and further comprising identifying a card position wherein card position information is combined with line scanning information and is correlated to stored reference vector sets in a field programmable gated array to determine suit and rank.

22. The method of claim 21 wherein information of at least one of suit and rank from the field programmable gated array is stored in a database.

23. The method of claim 22 wherein information stored in said database is mined by a processor.

24. The method of claim 21 wherein information of at least one of suit and rank from the field programmable gated array is stored in a card identification module.

* * * * *